US005558973A

United States Patent [19]

Yamada

[11] Patent Number: 5,558,973

[45] Date of Patent: Sep. 24, 1996

[54] HEAT-DEVELOPABLE COLOR LIGHT-SENSITIVE MATERIAL AND METHOD FOR PRODUCING THE SAME

[75] Inventor: Makoto Yamada, Kanagawa, Japan

[73] Assignee: Fuji Photo Film Co., Ltd., Kanagawa, Japan

[21] Appl. No.: 381,394

[22] Filed: Jan. 31, 1995

[30] Foreign Application Priority Data

Feb. 1, 1994 [JP] Japan ..... 6-010627

[51] Int. Cl.[6] ..... G03C 8/40; G03C 1/825

[52] U.S. Cl. ..... 430/203; 430/220; 430/507; 430/519; 430/617

[58] Field of Search ..... 430/617, 507, 430/220, 203, 519

[56] References Cited

U.S. PATENT DOCUMENTS

| | | | |
|---|---|---|---|
| 4,259,424 | 3/1981 | Endo et al. | 430/48 |
| 4,542,092 | 9/1985 | Toya et al. | 430/510 |
| 4,728,595 | 3/1988 | Hayashi et al. | 430/220 |
| 4,740,445 | 4/1988 | Hirai et al. | 430/203 |
| 5,071,740 | 12/1991 | Okauchi et al. | 430/617 |
| 5,098,820 | 3/1992 | McManus et al. | 430/507 |
| 5,264,316 | 11/1993 | Yamada et al. | 430/138 |
| 5,270,155 | 12/1993 | Ozaki et al. | 430/505 |
| 5,362,601 | 11/1994 | Miyake | 430/203 |

FOREIGN PATENT DOCUMENTS 0628869 12/1994 European Pat. Off. .

OTHER PUBLICATIONS

Chemical Abstracts On Line Search Results: Jul. 12, 1995.

*Primary Examiner*—Thorl Chea

*Attorney, Agent, or Firm*—Sughrue, Mion, Zinn, Macpeak & Seas

[57] ABSTRACT

A heat-developable color light-sensitive material is described, which comprises, on a support, at least a light-sensitive silver halide, a non-diffusible dye-donating compound capable of releasing or forming a diffusible dye in correspondence or reverse correspondence with a reaction of reducing the silver halide to silver, and a binder, which contains a specific solid organic pigment in at least one layer of a light-sensitive silver halide emulsion layer and/or its adjacent layer(s) and which contains an alginic acid derivative in the same layer containing the solid organic pigment.

3 Claims, No Drawings

HEAT-DEVELOPABLE COLOR LIGHT-SENSITIVE MATERIAL AND METHOD FOR PRODUCING THE SAME

FIELD OF THE INVENTION

The present invention relates to a heat-developable color light-sensitive material and a method for producing the same. More precisely, it relates to a heat-developable color light-sensitive material with improved color reproducibility and a method for producing the material.

BACKGROUND OF THE INVENTION

Various heat-developable light-sensitive materials are known. For example, such materials and photographic processes for processing them are described in *Bases of Photographic Engineering,* Edition of Nonsilver Photography (published by Corona Publishing Co., Ltd., Japan, 1982), pages 242 to 255.

Various methods have been proposed for forming color images by heat development. For instance, U.S. Pat. Nos. 3,531,286, 3,761,270, 4,021,240, Belgian Patent 802,519, *Research Disclosure* (hereinafter referred to as RD) in September 1975, pages 31 to 32 propose methods for forming color images by reaction of an oxidation product of a developing agent and couplers.

However, since the above-mentioned heat-developable light-sensitive materials for forming color images are of a non-fixing type, silver halides still remain in the processed materials. The silver halides remained in the processed materials cause a serious problem in that, when the processed materials are exposed to strong light or when they are stored for a long period of time, the white background areas in the materials are gradually colored. In addition, the above-mentioned photographic processes generally need a relatively long period of time for developing light-sensitive materials and have a drawback in that the images formed are highly fogged while having a low color density.

In order to overcome the problem and drawback, a method has been proposed in which a diffusive dye is imagewise formed or released under heat and the diffusive dye is transferred to an image-receiving material having therein a mordanting agent in the presence of a solvent such as water, as described in, for example, U.S. Pat. Nos. 4,500,626, 4,483,914, 4,503,137, 4,559,920, and JP-A-59-165054 (the term "JP-A" as used herein means an "unexamined published Japanese patent application).

However, this method is not satisfactory because the temperature for development is still high and the storability of raw stock is not sufficient. Different methods have been disclosed in JP-A-59-218443, JP-A-61- 238056, JP-A-62-129848 and European Patent 210660A2, in which a light-sensitive material is heat-developed in the presence of a base precursor and a small amount of water thereby transferring a dye to a dye-receiving material. According to these methods, the development is accelerated while the temperature for the development is lowered, and the processing steps are simplified.

Various methods have also been proposed for forming positive color images by heat development. For instance, U.S. Pat. No. 4,559,290 discloses a method in which an oxidized compound having no color image releasing capacity as derived from a so-called DRR compound is, in the presence of a reducing agent or a precursor thereof, reduced with the reducing agent which remains without being oxidized after oxidation of the agent in accordance with the exposed amount of a silver halide by heat development, to thereby release a diffusible dye. U.S. Pat. No. 4,783,396 and JP-A-64-13546 disclose a heat-developing color light-sensitive material having a compound which releases a diffusible dye by the same mechanism as mentioned above, or that is, releases a diffusible dye by reductive cleavage of the N—X bond of the compound (where X is an oxygen atom, a nitrogen atom or a sulfur atom). According to this method, a multilayered, heat-developing color light-sensitive material having, on a support, at least a light-sensitive silver halide, a binder, an electron donor and/or its precursor (preferably having a non-diffusible group), and a compound which may release a diffusible dye when reduced and which itself is non-diffusible is, after having been exposed, heated so that the electron donor is oxidized in accordance with the amount of the silver halide therein while the above-mentioned reusable dye-donating compound is reduced by the electron donor which has remained as it is without being oxidized, thereby releasing a diffusible dye, and the thus-released dye is transferred to a dye-fixing (image-receiving) material having therein a mordanting agent, thereby forming a positive color image on the material.

In general, ordinary silver halide color light-sensitive materials have a multi-layered structure, in which, for example, a panchromatic silver halide emulsion layer sensitive to red light, an orthochromatic silver halide emulsion layer sensitive to green light and, as the uppermost layer, a regular silver halide emulsion layer sensitive to blue light are coated on a support in this order from the side of the support.

In these color light-sensitive materials having the structure mentioned above, the panchromatic silver halide emulsion and the orthochromatic silver halide emulsion are color-sensitized with optical sensitizers which are generally referred to as sensitizing dyes. Such optical sensitizers or sensitizing dyes are sensitive to also the silver halide in the blue-sensitive emulsion layer, they cause color mixing or coloring failure due to the overlapping of the color spectra for the plural color-sensitive layers, after all detracting from the color reproducibility of the light-sensitive material.

In order to evade these problems, for example, a blue light-absorbing filter layer is generally provided between the blue-sensitive silver halide emulsion layer and the green-sensitive silver halide emulsion layer in a color negative light-sensitive material. As such a blue light-absorbing filter layer, for example, used is a layer comprising silver colloid of grains having a grain size of approximately from 0.001 to 0.05 μm or a layer containing a dye that dissolves out in processing solutions or decolors during processing. These methods are described in, for instance, U.S. Pat. Nos. 4,948,717, 4,948,718, 4,940,645 and 4,900,653.

In heat-developable color light-sensitive materials, where the dye-donating compound is a colored one, the layer itself containing this compound acts as a filter layer so that any additional blue light-absorbing filter layer is not always necessary. However, if the dye-donating compound in the material is a colorless coupler or if the extinction coefficient of the material at 500 nm or less is not sufficient, it is desirable to provide a blue light-absorbing filter layer in the material.

However, heat-developing light-sensitive materials cannot have a silver colloid layer such as that mentioned above. This is because silver colloid grains act as physically-developed nuclei in heat-developing light-sensitive materials, resulting in the increase in the fog of the material and the decrease in the color density of the same or causing mixing of colors in the material.

It is not also preferred to incorporate a dye that dissolves out in processing solutions or decolors during development into heat-developable light-sensitive materials. This is because heat-developable light-sensitive materials are generally processed within a short period of time so that the dye cannot often decolor during development and the dye remained in the processed material will be transferred to an image-receiving material to cause stains therein.

Japanese Patent Application No. 5-149713 describes a heat-developable color light-sensitive material containing a solid organic pigment in the light-sensitive silver halide emulsion layer and/or its adjacent layers. The described, heat-developing color light-sensitive material is free from color mixing and coloring failure and therefore has excellent color reproducibility. In this, in addition, no stain is formed.

However, when this material is processed to form a color image thereon, after having been stored under forced conditions, this is often much fogged. (The storing of light-sensitive materials under forced conditions is hereinafter referred to as storing of raw stock.) Where light-sensitive materials are produced, in general, the coating compositions containing the necessary components such as light-sensitive silver halides, etc. are left as they are for several hours. However, when the above-mentioned heat-developing color light-sensitive material is produced and when a coating composition containing a solid organic pigment is left as it is for a while, then large coarse grains are formed in the composition. It has been found that, if the coating composition containing such large coarse grains therein is coated on a support to produce a heat-developing color light-sensitive material and if the thus-produced material is exposed and processed to form an image thereon, the processed material has many non-colored areas having a size of about 0.1 mm or less. In producing light-sensitive materials, one coating machine is often used to produce plural kinds of light-sensitive materials. In such a case, if some components constituting the previous composition remained in the ducts and the like in the machine where coating compositions passes through, the next coating composition will be contaminated by the previous coating composition. Therefore, it is necessary that the components constituting coating compositions do not remain in the ducts and the like in the coating machine. To wash the ducts in the coating machine, it is desirable not to use organic solvents in view of the prevention of environmental pollution. However, it has been found that, when the coating composition containing a solid organic pigment adheres to the ducts in a coating machine in producing the above-mentioned color light-sensitive materials, then it is extremely difficult to wash the contaminated ducts.

SUMMARY OF THE INVENTION

Therefore, one object of the present invention is to provide a heat-developable color light-sensitive material having improved color reproducibility, which may form thereon a color image with little fog even after stored under forced conditions as its raw stock.

Another object of the present invention is to provide a method for producing a heat-developable color light-sensitive material, in which, even when a coating composition containing a solid organic pigment is stored as it is for a while and then coated on a support, the composition adhered to the ducts and the like, in a coating machine may easily be washed, while the material thus produced may form a good color image having no uncolored area therein.

These and other objects of the present invention have been attained by a heat-developable color light-sensitive material comprising, on a support, at least a light-sensitive silver halide, a non-diffusible dye-donating compound capable of releasing or forming a diffusiable dye in correspondence or reverse correspondence with a reaction of reducing the silver halide to silver, and a binder, which contains a solid organic pigment in the light-sensitive silver halide emulsion layer and/or its adjacent layer(s) and which contains an alginic acid derivative in the same layer containing the solid organic pigment.

These objects have also be attained by a method for producing a heat-developing color light-sensitive material having, on a support, at least a light-sensitive silver halide, a reducing agent, a non-diffusible dye-donating compound capable of releasing or forming a diffusible dye in correspondence or reverse correspondence with a reaction of reducing the silver halide to silver, and a binder, and containing a solid organic pigment in the light-sensitive silver halide emulsion layer and/or its adjacent layers, wherein the alginic acid derivative is contained in a coating solution of the solid organic pigment.

DETAILED DESCRIPTION OF THE INVENTION

The present invention will be described in detail hereunder.

The solid organic pigment to be used in the light-sensitive material of the present invention is substantially insoluble in water (the solubility to 100 g of water is 0.1 g or less at 20° C.). Examples of such solid organic pigments are described in detail in JP-A-6-337511.

Preferred examples of the solid organic pigments for use in the present invention are represented by the following formula (I):

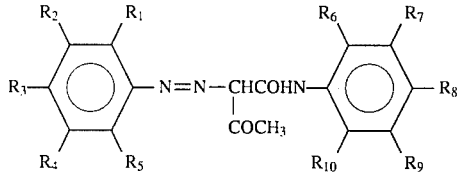

(I)

wherein $R_1$, $R_2$, $R_3$, $R_4$, $R_5$, $R_6$, $R_7$, $R_8$, $R_9$ and $R_{10}$ ($R_1$ to $R_{10}$) each represents a hydrogen atom, a halogen atom (e.g., chlorine, fluorine, bromine), an alkyl group (e.g., methyl, ethyl), an alkoxy group (e.g., methoxy, ethoxy), a nitro group, an acyl group (e.g., acetyl, propionyl, benzoyl), an aryl group (e.g., phenyl), an aryloxy group (e.g., phenoxy), a sulfamoyl group, an alkylsulfamoyl group (e.g., methylsulfamoyl, ethylsulfamoyl), an arylsulfamoyl group (e.g., phenylsulfamoyl), an alkoxycarbonyl group (e.g., methoxycarbonyl, ethoxycarbonyl), an aryloxycarbonyl group (e.g., phenoxycarbamoyl a carbamoyl group, an alkylcarbamoyl group (e.g., methylcarbonyl, ethylcabamoyl), an arylcarbamoyl group (e.g., phenylcarbamoyl), an acylamino group (e.g., acetylamino, benzoylamino), an alkylsulfonylamino group (e.g., methylsulfonylamino), an arylsulfonylamino group (e.g., phenytsulfonylamino), a ureido group, or a group represented by formula (II):

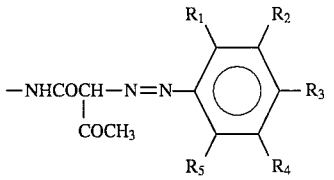

(II)

These substituents for $R_1$ to $R_{10}$ may be further substituted by one or more of the above-described substituents. Examples thereof include a 2-methyl-4-chlorophenylsulfamoyl group, a 2-methyl-3-chloro-phenylcarbamoyl group, and a trifluoromethyl group.

In formula (II), $R_1$ to $R_5$ have the same meanings as those in formula (I). However, $R_1$ to $R_5$ in formula (II) are each the same as or different from $R_1$ to $R_5$ in formula (I). In formula (I) or (II), $R_1$ and $R_2$; $R_2$ and $R_3$; $R_3$ and $R_4$; $R_4$ and $R_5$; $R_6$ and $R_7$; $R_7$ and $R_8$; $R_8$ and $R_9$; or $R_9$ and $R_{10}$ on the same benzene ring may be combined with each other to form a heterocyclic ring (e.g., imidazolone ring, imido ring). The pigment may be a symmetric biscomposed formed by bonding two formulae (I) via $R_3$ or $R_8$, or via a single bond at a position of $R_3$ or $R_8$.

It is desirable that the organic pigment for use in the present invention is substantially insoluble also in high boiling point organic solvents such as phosphates and phthalates, and in low boiling point organic solvents such as ethyl acetate, methyl ethyl ketone, cyclohexanone, and methanol. It is also desirable that the organic pigment does not have, as the substituent, a large ballast group such as an alkyl group having 8 or more carbon atoms and an aryl group substituted by alkyl group(s) having 4 or more carbon atoms.

From these viewpoints, it is especially desirable that the organic pigment is a symmetric compound.

It is desirable that the organic pigment for use in the present invention has an absorption peak at 500 nm or less, preferably from 3,60 to 500 nm.

Examples of the solid organic pigment for use in the present invention are mentioned below, which, however, are not limited.

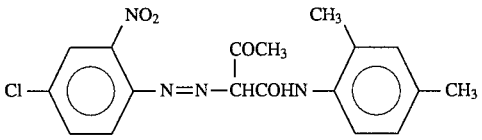

(1)

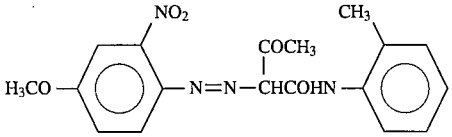

(2)

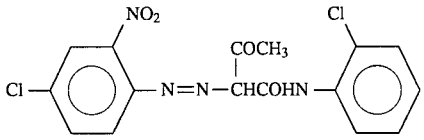

(3)

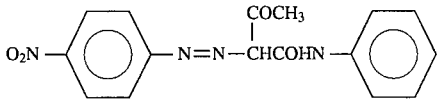

(4)

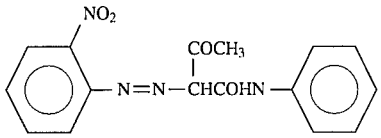

(5)

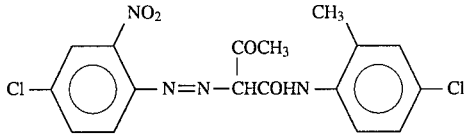

(6)

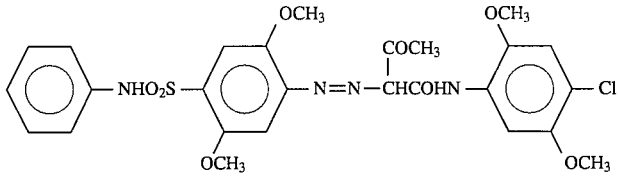

(7)

-continued
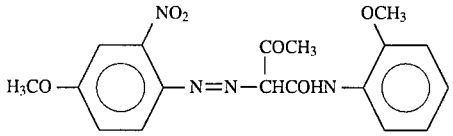
(8)
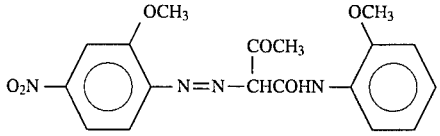
(9)
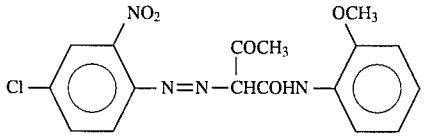
(10)
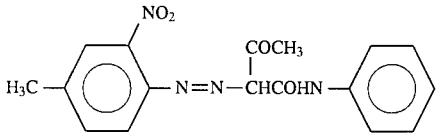
(11)
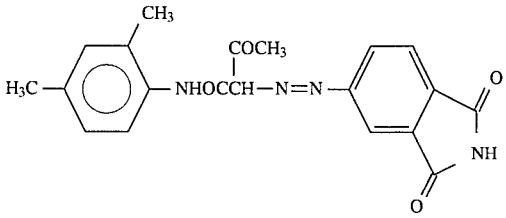
(12)
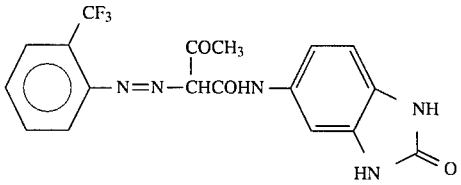
(13)
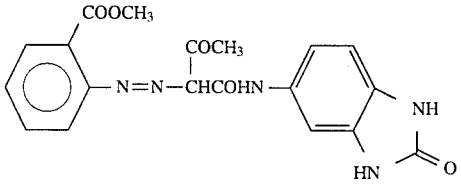
(14)
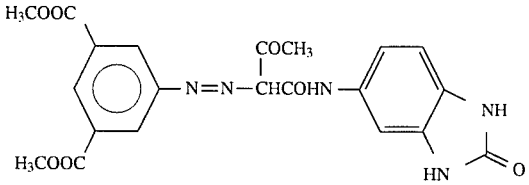
(15)
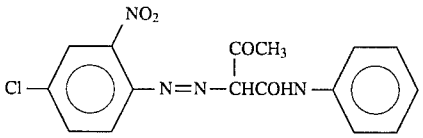
(16)
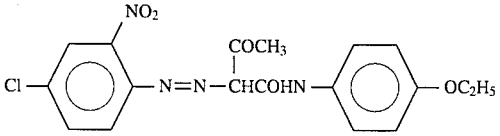
(17)

-continued
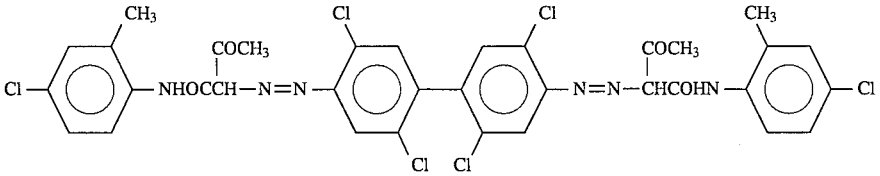
(18)
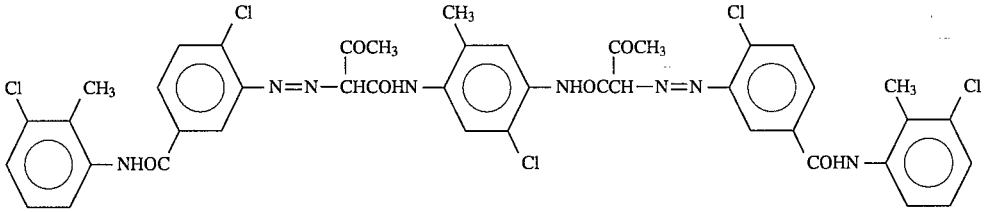
(19)
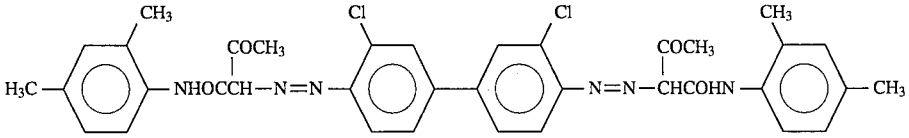
(20)
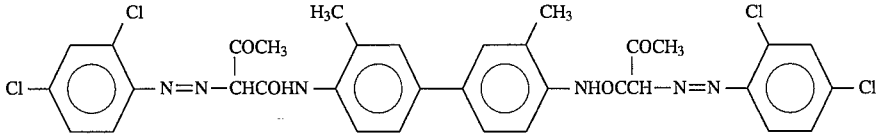
(21)
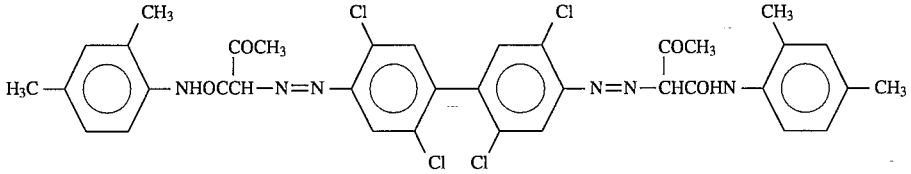
(22)
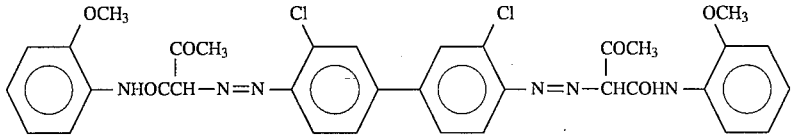
(23)
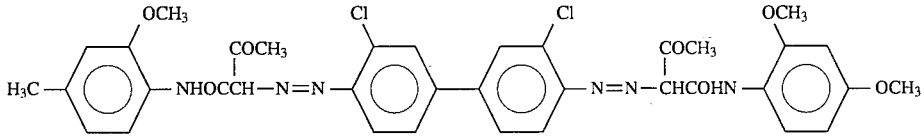
(24)
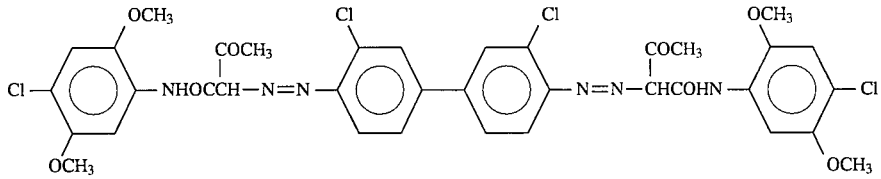
(25)
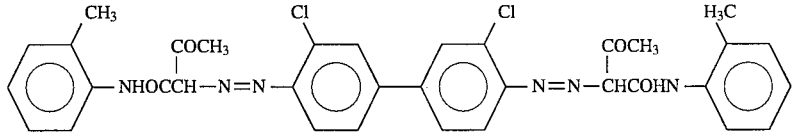
(26)
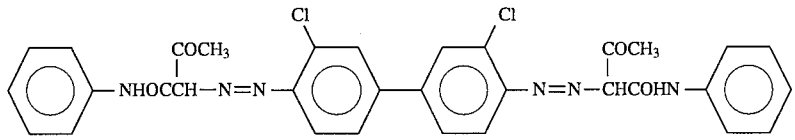
(27)

-continued

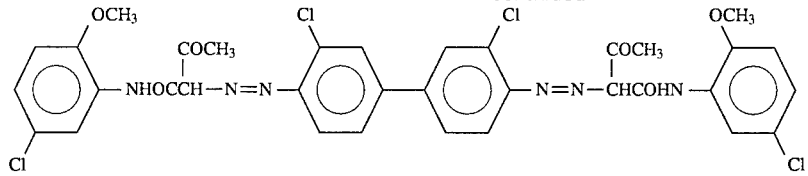

(28)

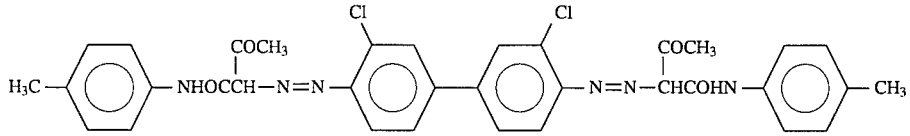

(29)

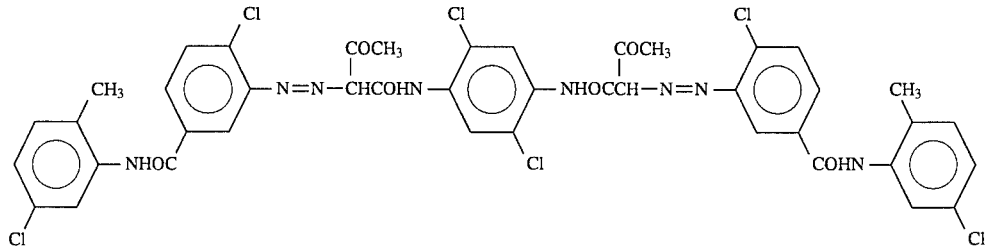

(30)

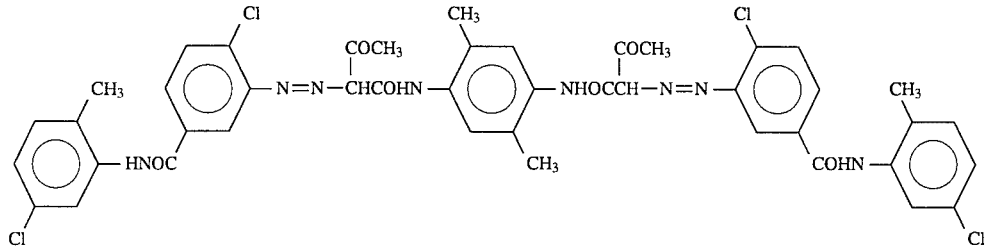

(31)

According to the present invention, the solid organic pigment is dispersed in a hydrophilic binder as its fine solid grains. The method for preparing the dispersion of the solid organic pigment is described in JP-A-59-174830. The fine grains of the pigment have a mean grain size of from 0.001 to 5 μm, preferably from 0.01 to 2 μm. In the present invention, the organic pigment may be used singly or as a combination of two or more of them. If desired, the fine grains of the organic pigment may be dispersed in a hydrophilic binder along with fine grains of other materials that are incorporated into the light-sensitive material of the present invention (for example, inorganic pigments such as hardly water-soluble basic metal compounds, and organic compounds such as hydrophobic polymers).

In the light-sensitive material of the present invention, the solid organic pigment is incorporated into the light-sensitive silver halide emulsion layer or its adjacent layers. The light-sensitive silver halide emulsion layer to which the pigment shall be added is not specifically defined but is desirably any of others than a blue-sensitive layer in order to prevent the lowering of the sensitivity of the material. Examples of the adjacent layer to which the pigment is added include dye-donating compound-containing layers (e.g., yellow dye-donating compound-containing layer, magenta dye-donating compound-containing layer, cyan dye-donating compound-containing compound) which are separately provided in the material in accordance with the color sensitivity of the light-sensitive silver halides in the material, if such layers are provided, and interlayers to be provided between a light-sensitive silver halide emulsion layer (containing a dye-donating compound) and a light-sensitive silver halide emulsion layer having a different color sensitivity. In the light-sensitive material of the present invention, the organic pigment may be added only one layer and two or more layers.

The most preferred embodiment of the heat-developable color light-sensitive material of the present invention has, on a support, at least three layers each containing at least a light-sensitive silver halide, a reducing agent, a dye-donating compound and a binder, in which these layers are color-sensitized to be blue-sensitive, green-sensitive and red-sensitive, respectively, and in which the interlayer between the blue-sensitive layer and the green-sensitive layer or the interlayer between the blue-sensitive layer and the red-sensitive layer contains a solid organic pigment and an alginic acid derivative.

The content of the organic pigment to be in the light-sensitive material of the present invention varies, depending on the kind of the pigment, the kind of the dye-donating compound, the intrinsic sensitivity of the light-sensitive silver halide, the dispersed condition of the pigment, etc. In general., it may be from 1 mg to 5000 mg, preferably from 10 mg to 1000 mg, per $m^2$ of the material. The percentage of the organic pigment is preferably from 1 to 200% by weight based on the weight of the binder in the layer containing the pigment.

The alginic acid derivatives usable in the present invention are described in detail in, for example, *Water-soluble Polymers* (edited by Chemical Industry Co., Japan), and *Water-soluble Polymers—Current Situations of Their Market and Industrial Utilization* (published by CMC, Japan). The examples of the alginic acid derivatives for use in the present invention include alkali metal, alkaline earth metal, ammonium or quaternary alkyl ammonium alginates; salts of alginic acid and organic bases such as aliphatic amines, aromatic amines, heterocyclic amines, amidines, cyclic amidines, guanidines, and cyclic guanidines; and esters, such as propylene glycol esters, nitrates, sulfates and fatty acid esters, of alginic acid. Since the alginic acid derivative is added to the same coating solution containing the solid organic pigment according to the present invention, it is desirable that the alginic acid derivative is soluble in water. Especially preferred are alkali metal salts, ammonium salts, aliphatic amine salts and propylene glycol esters of alginic acid. It is known that alginates of divalent metals such as calcium have noticeably lowered water-solubility. Therefore, when alginate salts are coated according to the present invention, it is possible to add the above-mentioned alginates of divalent metals to the coated layer or to the layer containing no alginate salt, thereby lowering the water-solubility of the coated alginate salt and thus fixing the salt in the light-sensitive material. The alginic acid derivatives to be used in the present invention are not specifically defined with respect to the degree of polymerization. However, it is more desirable that the derivatives have a degree of polymerization of 1000 or less. The amount of the alginic acid derivative to be added to the light-sensitive material of the present invention is preferably from 0.01 to 10 parts by weight, more preferably from 0.05 to 5 parts by weight, based on one part by weight of the solid organic pigment in the material.

The method of adding the alginic acid derivative to the light-sensitive material according to the present invention is not specifically defined. The alginic acid derivative may be added at any stage for the step of dispersing the solid organic pigment in a hydrophilic binder or for the step of preparing the coating solution.

The heat-developable light-sensitive material of the present invention basically has, on a support, at least a light-sensitive silver halide emulsion, a reducing agent, a binder, and a dye-donating compound (which may be replaced by the reducing agent in the manner as mentioned below). If desired, it may further contain an organic metal salt oxidizing agent, etc.

These components are in most cases incorporated into one and the same layer, but they may be added separately to different layers. For instance, if a colored dye-donating compound is in the layer below a silver halide emulsion layer, it is effective for preventing lowering of the sensitivity of the emulsion layer. A reducing agent is preferably incorporated into a heat-developable light-sensitive material. Alternatively, it may also be supplied to the material from an external source of a dye-fixing material by diffusing it to the light-sensitive material from the dye-fixing material.

In order to obtain colors of a broad range in a chromaticity diagram by using three primary colors of yellow, magenta and cyan, a combination of at least three silver halide emulsion layers each having a light-sensitivity in a different spectral region is used. For instance, usable are a combination of three layers of a blue-sensitive layer, a green-sensitive layer and a red-sensitive layer, a combination of a green-sensitive layer, a red-sensitive layer and an infrared-sensitive layer, and a combination of a red-sensitive layer, an infrared-sensitive layer (I) and an infrared-sensitive layer (II), such as those described in JP-A-59-180550, JP-A-64-13546, JP-A-62-253159, EP-A-479167. The respective light-sensitive layers may be arranged in any desired sequence as generally employed in ordinary color light-sensitive materials. If desired, these light-sensitive layers each may be composed of two or more plural layers each having a different sensitivity degree as described in JP-A-1-252954.

The heat-developable light-sensitive material may have various non-light-sensitive layers, such as protective layer, subbing layer, interlayer, yellow filter layer, and anti-halation layer, between the above-mentioned silver halide emulsion layers or as the uppermost layer or the lowermost layer. It may also have various auxiliary layers such as backing layer on the side of the support opposite to that coated with the silver halide emulsion layers. Examples of such non-light-sensitive layers and auxiliary layers include the layer constitutions described in the above-mentioned patent publications, the subbing layer described in U.S. Pat. No. 5,051,335, the interlayer containing a solid pigment described in JP-A-1-167838 and JP-A-61-20943, the interlayer containing a reducing agent and a DIR compound described in JP-A-1-120553, JP-A-5-34884 and JP-A-2-64634, the interlayer containing an electron transmitting agent described in U.S. Pat. Nos. 5,017,454, 5,139,919 and JP-A-2- 235044, the protective layer containing a reducing agent described in JP-A-4-249245, and combinations of these layers.

It is desirable that the support of the heat-developable light-sensitive material of the present invention is designed to have an antistatic function and have a surface resistivity of $10^{12}$ Ω.cm or less.

The silver halide for use in the present invention may be any of silver chloride, silver bromide, silver iodobromide, silver chlorobromide, silver chloroiodide and silver chloroiodobromide.

The silver halide emulsion for use in the present invention may be either a surface latent image type emulsion or an internal latent type emulsion. The latter internal latent type emulsion is used as a direct reversal emulsion, in combination with a nucleating agent or with light fogging. The emulsion may also be a so-called core/shell emulsion in which the inside phase and the surface phase of each grain are different from each other, or an emulsion comprising epitaxial grains grown by epitaxial conjugation to have different silver halides. The silver halide emulsion may be either a monodispersed one or a polydispersed one. To prepare the emulsion, preferably employed is a method of blending plural monodispersed emulsions so as to adjust the gradation of the emulsion mix, such as described in JP-A-1-167743, JP-A- 4-223463. The grain size of emulsion grains may be from 0.1 to 2 μm, especially preferably from 0.2 to 1.5 μm. Regarding the crystal habit of silver halide grains, the grains may be regular crystalline ones such as cubic, octahedral or tetradecahedral ones, or irregular crystalline ones such as spherical ones or tabular ones having a high aspect ratio, or twin-crystalline ones having crystal defects, or composite ones composed of such grains.

Concretely, usable in the present invention are all silver halide emulsions prepared by the methods described in, for example, U.S. Pat. No. 4,500,626 (column 50), U.S. Pat. No. 4,628,021; No. 17029 (1978), RD No. 17643 (December, 1978), pages 22 and 23, RD No. 18716 (November, 1979), page 648, RD No. 307105 (November, 1989), pages 863 to 865; JP-A-62-253159, JP-A-64-13546, JP-A-2-236546, JP-A-3-110555; P. Glafkides, *Chemie et Phisigue Photographigue* (Paul Montel, 1967); G. F. Duffin, *Photographic Emulsion Chemistry* (Focal Press, 1966); V. L. Zelikman et al., *Making and Coating Photographic Emulsion* (Focal Press, 1964).

The light-sensitive silver halide emulsions for use in the present invention are preferably de-salted so as to remove the excess salts therefrom. For the de-salting, for example, employable are a noodle-washing method where gelatin is gelled and a flocculation method using polyanionic inorganic salts (e.g., sodium sulfate), anionic surfactants, anionic polymers (e.g., sodium polystyrenesulfonate) or gelatin derivatives (e.g., aliphatic acylated gelatins, aromatic acylated gelatins, aromatic carbamoylated gelatins). Preferred is the flocculation method.

The light-sensitive silver halide emulsions for use in the present invention may contain heavy metals, such as iridium, rhodium, platinum, cadmium, zinc, thallium, lead, iron, and osmium, for various purposes. Compounds of such heavy metals may be added to the emulsions singly or as a mixture of two or more of them. The amount of the compounds to be added varies, depending On the object, and is, in general, approximately from $10^{-9}$ to $10^{-3}$ mol per mol of the silver halide in the emulsion. The compounds may be incorporated uniformly into the silver halide grains or locally into or onto the insides or the surfaces of the grains. Concretely, preferred are the emulsions described in JP-A-2-236542, JP-A-1-116637 and JP-A-5-181246.

At the stage of forming the grains of the light-sensitive silver halide emulsions for use in the present invention, it is possible, if desired, to add to the grains, as a silver halide solvent, rhodanates, ammonia or 4-substituted thioether compounds, as well as organic thioether derivatives such as described in JP-B-47-11386 (the term "JP-B" as used herein means an "examined Japanese patent publication"), or sulfur-containing compounds such as described in JP-A-53-144319.

For other conditions in preparing the silver halide emulsions for use in the present invention, referred to are the disclosures in the above-mentioned, P. Glafkides, *Chemie et Phisigue Photographique* (Paul Morttel, 1967); G. F. Duffin, *Photographic Emulsion Chemistry* (Focal Press, 1966); and V. L. Zelikman et al., *Making and Coating Photographic Emulsion* (Focal Press, 1964). For instance, employable is any of an acid method, a neutral method and an ammonia method. As the system of reacting soluble silver salts and soluble halides, employable is any of a single jet method, a double jet method and a combination of these. To obtain monodispersed emulsions, preferably employed is a double jet method.

A reversed mixing method may also be employed so as to form silver halide grains in the presence of excess silver ions. As one system of a double jet method, employable is a so-called, controlled double jet method where the pAg value in the liquid phase to give silver halide grains is kept constant.

To accelerate the growth of grains, the concentrations, the amounts and the addition speeds of silver salts and halides to be added may be increased as described in, for example, JP-A-55-142329, JP-A-55-158124, and U.S. Pat. No. 3,650,757.

To stir the reaction system for forming silver halide grains, any known stirring method may be employed. The temperature and the pH value of the reaction system may be determined at any desired ones during the formation of silver halide grains, in accordance with the object. Preferably, the pH value of the system falls within the range between 2.2 and 8.5, more preferably between 2.5 and 7.5.

The light-sensitive silver halide emulsions for use in the present invention are, in general, chemically sensitized. To chemically sensitize the emulsions, any of chalcogen sensitization such as sulfur sensitization, selenium sensitization and tellurium sensitization, noble metal sensitization using gold, platinum or palladium, and reduction sensitization, which are known to be employable for sensitizing ordinary photographic emulsions, can be employed singly or as a combination of them. For the chemical sensitization, for example, the disclosures in JP-A-3-110555 and JP-A-5-241267 are referred to. The chemical sensitization may be carried out in the presence of nitrogen-containing heterocyclic compounds as described in JP-A-62-253159. In addition, an antifoggant which will be mentioned hereinafter can be added to the chemically-sensitized emulsions. For instance, employable are the methods described in JP-A-5-45833, JP-A-62-40446.

During the chemical sensitization, the pH value of the emulsion to be sensitized is preferably from 5.3 to 10.5, more preferably from 5.5 to 8.5, and the pAg value thereof is preferably from 6.0 to 10.5, more preferably from 6.8 to 9.0.

In the light-sensitive material of the present invention, the amount of the light-sensitive silver halide emulsions to be coated is from 1 mg/m$^2$ to 10 g/m$^2$ in terms of silver therein.

The light-sensitive silver halide emulsions for use in the present invention may be color-sensitized with, for example, methine dyes, by which the silver halide grains therein are made green-sensitive, red-sensitive or infrared-sensitive. In addition, the blue-sensitive emulsion may also be color-sensitized to make it sensitive to blue light, if necessary.

Examples of the dyes for this purpose include cyanine dyes, merocyanine dyes, complex cyanine dyes, complex merocyanine dyes, holopolar cyanine dyes, hemicyanine dyes, styryt dyes and hemioxonol dyes.

Concretely mentioned are sensitizing dyes described in U.S. Pat. No. 4,617,257, JP-A-59-180550, JP-A- 64-13546, JP-A-5-45828, JP-A-5-45834.

These sensitizing dyes may be used singly or as a combination of them. The combination of plural sensitizing dyes is often used for the purpose of super-color sensitization or of controlling the wavelength range for color sensitization.

Dyes which do not have a color-sensitizing activity by themselves or compounds which do not substantially absorb visible rays but which show a super-color sensitizing activity may be incorporated into emulsions along with sensitizing dyes. Examples of such dyes or compounds are described in U.S. Pat. No. 3,615,641 and JP-A- 63-23145.

The time of adding such sensitizing dyes into emulsions may be before or after chemical ripening of emulsions. As the case may be, it may be before or after formation of nuclei of silver halide grains, in accordance with U.S. Pat. Nos. 4,183,756 and 4,225,666. These dyes and super-color sensitizers can be added to emulsions as their solutions in organic solvents such as methanol, their dispersions in gelatin or their solutions containing surfactants. Their amounts to be added may be from $10^{-8}$ to $10^{-2}$ mol per mol of the silver halide in the emulsion.

Additives usable in these steps as well as other known photographic additives usable in preparing the heat-developable light-sensitive material of the present invention and dye-fixing (image-receiving) materials are described in the above-mentioned RD Nos. 17643, 18716 and 307105, and the relevant parts in these RD's are mentioned below.

| | Additive | RD 17643 | RD 18716 | RD 307105 |
|---|---|---|---|---|
| 1. | Chemical Sensitizer | p. 23 | p. 648, right column (RC) | p. 866 |
| 2. | Sensitivity Increasing Agent | | ditto | |
| 3. | Spectral Sensitizer, Supersensitizer | pp. 23–24 | p. 648, RC to p. 649, RC | pp. 866–868 |
| 4. | Brightening Agent | p. 24 | p. 648, RC | p. 868 |
| 5. | Antifoggant, Stabilizer | pp. 24–25 | p. 649, RC | pp. 868–870 |
| 6. | Light Absorbent, Filter Dye, | pp. 25–26 | p. 649, RC to P. 650, left | p. 873 |

-continued

| | Additive | RD 17643 | RD 18716 | RD 307105 |
|---|---|---|---|---|
| | Ultraviolet Absorbent | | column (LC) | |
| 7. | Dye Image Stabilizer | p. 25 | p. 650, LC | p. 872 |
| 8. | Hardening Agent | p. 26 | p. 651, LC | pp. 874–875 |
| 9. | Binder | p. 26 | ditto | pp. 873–874 |
| 10. | Plasticizer, Lubricant | p. 27 | P. 650, RC | p. 876 |
| 11. | Coating Aid, Surface Active Agent | pp. 26–27 | ditto | p. 875–876 |
| 12. | Antistatic Agent | p. 27 | ditto | pp. 876–877 |
| 13. | Matting Agent | | | pp. 878–879 |

As the binder to be used in the layers of constituting heat-developable light-sensitive materials and dye-fixing materials, hydrophilic substances are preferably used. Examples thereof are described in the above-mentioned Research Disclosures and JP-A-64-13546, pages 71 to 75. Concretely, transparent or semi-transparent hydrophilic binders are preferred. Specific examples thereof include natural compounds, such as proteins (e.g., gelatin, gelatin derivatives), and polysaccharides (e.g., cellulose derivatives, starch, gum arabic, dextran, pullulane); and synthetic polymer compounds (e.g., polyvinyl alcohol, polyvinyl pyrrolidone, acrylamide polymers). In addition, highly water-absorbing polymers described in U.S. Pat. No. 4,960,681 and JP-A-62- 245260, such as homopolymers of vinyl monomers having —COOM or —$SO_3M$ (where M is a hydrogen atom or an alkali metal), or copolymers of such vinyl monomers or copolymers of such vinyl monomers along with other vinyl monomers (e.g., sodium methacrylate, ammonium methacrylate, Sumikagel L-5H produced by Sumitomo Chemical Company Limited) may also be used. Such binders may be used as a combination of two or more of them. Gelatin may be selected from lime-processed gelatin, acid-processed gelatin and delimed gelatin having a reduced content of calcium, if necessary. A combination of such gelatins is also preferably employed.

Where a system of effecting heat development while applying a slight amount of water thereto is employed in carrying out the present invention, the light-sensitive material of the present invention is desired to contain the high water-absorbing polymer. This is because the material containing such a high water-absorbing polymer can absorb water rapidly. It is also preferred to incorporate the high water-absorbing polymer into the dye-fixing layer and the protective layer therefor. This is because the dye transferred to the dye-fixing material containing such a high water-absorbing polymer in the dye-fixing layer is prevented from being again transferred to other materials.

In the light-sensitive material of the present invention, the amount of the binder to be coated is preferably 20 g or less, more preferably 10 g or less, and especially preferably from 0.5 g to 7 g, per $m^2$ of the material.

In the present invention, an organic metal salt may be used as an oxidizing agent with the light-sensitive silver halide emulsion. Of such organic metal salts, especially preferred are organic silver salts.

As organic compounds used for forming such organic silver salt oxidizing agents, there can be mentioned, for example, benzotriazoles, fatty acids and other compounds described in U.S. Pat. No. 4,500,626 (columns 52 and 53). In addition, acetylene silver described in U.S. Pat. No. 4,775,613 is also useful. Two or more kinds of organic silver salts may be employed in combination.

The above-mentioned organic silver salt may be added to the emulsion in an amount of from 0.01 to 10 mols, preferably from 0.01 to 1 mol, per mol of the light-sensitive silver halide. The total amount of the light-sensitive silver halide emulsion and the organic silver salt coated is from 0.05 to 10 g/$m^2$, more preferably from 0.1 to 0.4 g/$m^2$, in terms of silver.

As the reducing agent for use in the present invention, any one which is known in the field of heat-developable light-sensitive materials can be employed. Such agent also includes dye-donating compounds having a reducing property, which will be mentioned hereafter. In this case, another reducing agent(s) can be used, if desired, in combination with such a reducing dye-donating compound. In addition, reducing agent precursors which do not have a reducing property by themselves but which show a reducing capacity with the aid of a nucleating reagent or under heat during the step of development may also be employed.

As examples of reducing agents which can be employed in the present invention, reducing agents and reducing agent precursors as described in U.S. Pat. No. 4,500,626 (columns. 49 and 50), U.S. Pat. No. 4,483,914 (columns 30 and 31), 4,330,617 and 4,590,152, JP-A-60-140355 (pages 17 and 18), JP-A-57-40245, JP-A-56-138736, JP-A-59-178458, JP-A- 59-53831, JP-A-59-182449, JP-A-59-182450, JP-A-60-119555, JP-A-60-128436 through JP-A-60-128439, JP-A-60-198540, JP-A-60-181742, JP-A-61-259253, JP-A-62-244044 and JP-A-62- 131253, JP-A-62-131256, JP-A-63-10151, JP-A-64-13546 (pages 40 to 57), JP-A-1-120553, JP-A-2-32338, JP-A-2- 35451, JP-A-2-234158, JP-A-3-160443 and EP-A-220746 (pages 78 to 96) can be used.

Combinations of various reducing agents described in U.S. Pat. No. 3,039,869 can also be employed.

Where non-diffusible reducing agents are used in accordance with the present invention, an electron-transferring agent and/or an electron-transferring agent precursor can be used, if desired, in combination with such a reducing agent for the purpose of accelerating the movement of electrons between the non-diffusible reducing agent and the heat-developable silver halide. Those described in U.S. Pat. No. 5,139,919, EP-A-418743, JP-A-1- 138556 and JP-A-3-102345 are especially preferred. In addition, the method in which these agents are stably incorporated as described in JP-A-2-230143 and JP-A-2- 235044 are preferred.

The electron transferring agent or precursor thereof can be selected from the above-mentioned reducing agents and precursors thereof. The electron-transferring agent or precursor thereof is desired to have a higher mobility than the non-diffusible reducing agent (electron donor). Especially useful electron-transferring agents are 1-phenyl-3-pyrazolidones and aminophenols.

The non-diffusible reducing agent (electron donor) employed in combination with the electron-transferring agent may be any one of the above-mentioned reducing agents which are substantially immobile in the layers of a light-sensitive material. Preferably, there can be mentioned hydroquinones, sulfonamidophenols, sulfonamidonaphthols and the compounds described in JP-A-53-110827, U.S. Pat. Nos. 5,032,487, 5,026,634 and 4,839,272 as electron donors, as well as non-diffusible and reducing dye-donating compounds which will later be mentioned.

Further, an electron donor precursor as described in JP-A-3-160443 may be preferably used.

Moreover, the interlayer and protective layer may comprise the foregoing reducing agents incorporated therein for various purposes such as prevention of color mixing, improvement in color reproducibility, improvement in the properties of white background and prevention of silver migration to the dye-fixing material. Specifically, reducing agents as disclosed in EP-A-524649, EP-A- 357040, JP-A-4-249245, JP-A-2-64633, JP-A-2-46450, and JP-A-63-186240 are preferably used. Further, development inhibitor-releasing reducing compounds as described in JP-B-3-63733, JP-A-1-150135, JP-A-2-110557, JP-A-2-64634, JP-A- 3-43735, and EP-A-451833 may be used.

In accordance with the present invention, the total amount of the reducing agent is from 0.01 to 20 mol, especially preferably from 0.1 to 10 mol, per mol of silver.

The light-sensitive material of the present invention may contain a compound which can form or release a mobile dye in correspondence or reverse correspondence with the reaction of reducing silver ion into silver as an image-formable substance under high temperature conditions, namely a dye-donating compound.

As examples of the dye-donating compounds employed in the present invention, there can be mentioned compounds (couplers) capable of forming a dye by an oxidation-coupling reaction. The coupler may be either 4-equivalent couplers or 2-equivalent couplers. 2-Equivalent couplers which have a non-diffusible group as the releasing group and which form a diffusible dye by an oxidation-coupling reaction are preferred. The non-diffusible group may be in the form of a polymer chain. Examples of color developing agents and couplers for use in the present invention are described in detail in T. H. James, *The Theory of the Photographic Process,* 4th Ed., pages 291 to 334 and 354 to 361 and in JP-A-58-123533, JP-A-58-149046, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474 and JP-A-60-66249.

A further example of the dye-donating compound includes a compound adapted to imagewise release or spread a diffusible dye. Compounds of such type can be represented by the formula (LI):

$$((\text{Dye})_m\text{—Y})_n\text{—Z} \qquad \text{(LI)}$$

wherein Dye represents a dye group or dye precursor group whose wavelength has been temporarily shortened; Y represents a chemical bond or a linking group; Z represents a group which either causes a differential in the diffusibility of the compound $((\text{Dye})_m\text{—Y})_n\text{—Z}$ or releases $(\text{Dye})_m\text{—Y}$ and causes a differential in diffusibility between released $(\text{Dye})_m\text{—Y}$ and $((\text{Dye})_m\text{—Y})_n\text{—Z}$ in correspondence or reverse correspondence with photosensitive silver halide imagewise having a latent image; m represents an integer of 1 to 5; and n represents 1 or 2, and when either of n and m is not 1, the plural Dye groups may be the same as or different from each other.

As specific examples of the dye-donating compounds of the formula (LI), the following compounds (1) through (5) are mentioned. Compounds (1) through (3) form a diffusible color image (positive color image) in reverse correspondence with the development of silver halide and compounds (4) and (5) form a diffusible color image (negative color image) in correspondence with the development of silver halide.

(1) Dye developers comprising a combination of a hydroquinone developing agent and a dye component, as described in U.S. Pat Nos. 3,134,764, 3,362,819, 3,597,200, 3,544,545, 3,482,972 and JP-B-3-68387. The dye developers are diffusible under alkaline conditions but become nondiffusible after reaction with silver halide.

(2) Non-diffusible compounds which release a diffusible dye under alkaline conditions but which lose such capacity when reacted with silver halide can also be used, as described in U.S. Pat. No. 4,503,137. As examples of such compounds, there can be mentioned compounds which release a diffusible dye by an intramolecular nucleophilic substitution reaction, as described in U.S. Pat. No. 3,980,479; and compounds which release a diffusible dye by an intramolecular rearrangement reaction of the isoxazolone ring in their molecule, as described in U.S. Pat. No. 4,199,354.

(3) Non-diffusible compounds capable of reacting with a reducing agent which remains without being oxidized after development to release a diffusible dye can also be used, as described in U.S. Pat. No. 4,559,290, EP-A-220746, U.S. Pat. No. 4,783,396, Japanese Disclosure Bulletin 87- 6199 and JP-A-64-13546.

As examples of such compounds, there can be mentioned compounds which release a diffusible dye by an intramolecular nucleophilic substitution reaction after reduction, as described in U.S. Pat. No. 4,139,389 and 4,139,379 and JP-A-59-185333 and JP-A-57-84453; compounds which release a diffusible dye by an intramolecular electron-transfer reaction after reduction, as described in U.S. Pat. No. 4,232,107, JP-A-59-101649 and JP-A-61-88257 and RD No. 24025 (April, 1984); compounds which release a diffusible dye by cleavage of a single bond after reduction, as described in DE-A-3008588, JP-A-56-142530 and U.S. Pat. Nos. 4,343,893 and 4,619,884; nitro compounds which release a diffusible dye after electron reception, as described in U.S. Pat. No. 4,450,223; and compounds which release a diffusible dye after electron reception, as described in U.S. Pat. No. 4,609,610.

More preferably, there can be mentioned compounds having an N—X bond (where X is an oxygen, sulfur or nitrogen atom) and an electron-attracting group in one molecule, as described in EP-A-220746, Japanese Disclosure Bulletin 87-6199, U.S. Pat. No. 4,783,396, and JP-A-63- 201653, JP-A-63-201654 and JP-A-64-13546; compounds having an SO2-X groups (where X has the same meaning as mentioned above) and an electron-attracting group in one molecule, as described in JP-A-1-26842; compounds having a PO—X bond (where X has the same meaning as mentioned above) and an electron-attracting group in one molecule, as described in JP-A-63-271341; compounds having a C—X' bond (where X' has the same meaning as X mentioned above or means —$SO_2$—) and an electron-attracting group in one molecule, as described in JP-A-63-271341; and compounds which undergo cleavage of a single bond after reduction by π bond conjugated with an electron accepting group to release a diffusive dye, as described in JP-A-1-161237 and JP-A-1- 161342.

Above all, especially preferred are compounds having an N-X bond and an electron-attracting group in one molecule. Specific examples of such compounds include Compounds (1) to (3), (7) to (10), (12), (13), (15), (23) to (26), (31), (32), (35), (36), (40), (41), (44), (53) to (59), (64) and (70) described in EP-A-220746 or U.S. Pat. No. 4,783,396, Compounds (11) to (23) described in Japanese Disclosure Bulletin 87-6199 and Compounds (1) to (84) described in JP-A-64-13546.

(4) Compounds (DDR couplers) which have a diffusible dye as the releasing group and release the diffusible dye by reaction with an oxidation product of a reducing agent are also useful. Examples of such compounds are described in British Patent 1,330,524, JP-B-48-39165 and U.S. Pat. Nos. 3,443,940, 4,474,867 and 4,483,914.

(5) Compounds (DRR compounds) which have the property of reducing silver halides and organic silver salts and which release a diffusible dye after having reduced the halides or salts can also be used. As the compounds of this type can function even in the absence of any other reducing agent, they are advantageously free of the problem of staining of images by the oxidized and decomposed product of a reducing agent. Specific examples of these compounds are described in U.S. Pat. Nos. 3,928,312, 4,053,312, 4,055,428 and 4,336,322, JP-A-56- 65839, JP-A-59-69839, JP-A-53-3819 and JP-A-51-104343, RD No. 17465 (October, 1978), U.S. Pat. Nos. 3,725,062, 3,728,113 and 3,443,939, JP-A-58-116537 and JP-A-57-179840 and U.S. Pat. No. 4,500,626. As preferred examples of such DRR compounds, the compounds described in the abovementioned U.S. Pat. No. 4,500,626 at columns 22 to 44 are useful and above all Compounds (1) to (3), (10) to (13), (16) to (19), (28) to (30), (33) to (35), (38) to (40) and (42) to (64) described in U.S. Pat. No. 4,500,626 are preferred. In addition, the compounds described in U.S. Pat. No. 4,639,408 at columns 37 to 39 are also useful.

As dye-donating compounds other than the above-mentioned couplers and the compounds of formula (LI), dye-silver compounds comprising an organic silver salt and a dye bonded to each other (RD of May 1978, pages 54 to 58), azo dyes employable in a heat-developable silver dye bleaching method (U.S. Pat. No. 4,235,957, RD of April 1976, pages 30 to 32) and leuco dyes (U.S. Pat. Nos. 3,985,565 and 4,022,617) can also be employed in the present invention.

Hydrophobic additives such as the dye-donating compound and non-diffusible reducing agent can be incorporated into the layers of the light-sensitive material by any known method, for example, by the method described in U.S. Pat. No. 2,322,027. In this case, high boiling point organic solvents such as those described in JP-A-59-83154, JP-A-59-178451, JP-A-59-178452, JP-A-59- 178453, JP-A-59-178454, JP-A-59-178455 and JP-A-59-178457 can be used, optionally together with low boiling point organic solvents having a boiling point of from 50° C. to 160° C. These dye-donating compound, non-diffusible reducing agent, and high and low boiling point organic solvents may be used in combination of two or more thereof.

The amount of the high boiling point organic solvent used is 10 g or less, preferably 5 g or less, and more preferably from 0.1 g to 1 g, per gram of the dye-donating compound used. It is suitably one ml or less, more suitably 0.5 ml or less, especially suitably 0.3 ml or less, per gram of the binder.

In addition, a dispersion method with a polymer, as described in JP-B-51-39853 and JP-A-51-59943, and a method added as fine particle dispersion, as described in JP-A-62-30242, may also be employed.

When a compound to be incorporated into the layers of the heat-developable material of the present invention is substantially insoluble in water, it may be dispersed in the binder in the form of fine grains, in addition to the above-mentioned methods.

When the hydrophobic compound is dispersed in a hydrophilic colloid, various surfactants may be used. For instance, surfactants described in JP-A-59-157636, pages 37 and 38 and the above-described RDs may be used for such purpose.

The light-sensitive material of the present invention can contain a compound having a function of activating the developability thereof and of stabilizing the image formed. Examples of such compounds which can preferably be employed in the present invention are described in U.S. Pat. No. 4,500,626 at columns 51 and 52.

In the system of forming an image by diffusion and transfer of the dye, various compounds may be incorporated in the layers constituting the heat-developable light-sensitive material for the purpose of fixing or making undesirable dyes or colored matters colorless to improve the properties of the white background of the resulting image.

In some detail, compounds described in EP-A 353741, EP-A-461416, JP-A-63-163345 and JP-A-62-203158 may be used.

The layers constituting the heat-developable light-sensitive material according to the present invention can also comprise various pigments or dyes for the purpose of improving color separatability or raising sensitivity.

In some detail, compounds described in the above cited RDs, and compounds and layer structures described in EP-A-479167, EP-A-502508, JP-A-1-167838, JP-A-4-343355, JP-A-2-168252, JP-A-61-20943, EP-A-479167 and EP-A-502508 may be used.

In the system of forming an image by diffusion and transfer of the dye, a dye-fixing material is employed together with the heat-developable light-sensitive material of the present invention. Such systems can be classified into two major categories, a format in which the light-sensitive material and the dye-fixing material are separately disposed on two independent supports and a format in which the two materials are provided as coating layers on one and the same support. As regards the relation between the light-sensitive material and the dye-fixing material, the relation thereof to the support and the relation thereof to a white reflective layer, those described in U.S. Pat. No. 4,500,626 at column 57 are useful in the present invention.

The dye-fixing material which is preferably used in the present invention has at least one layer containing a mordant agent and a binder. As the mordant agent, any one known in the photographic field can be employed, and specific examples thereof include mordant agents described in U.S. Pat. No. 4,500,626 at columns 58 and 59, JP-A-61- 88256, pages 32 to 41 and JP-A-1-161236, pages 4 to 7; and those described in U.S. Pat. Nos. 4,774,162, 4,619,883 and 4,594,308. In addition, dye-receiving high polymer compounds, for example, those described in U.S. Pat. No. 4,463,079 can also be employed.

The hydrophilic binder is preferably used as the binder used in the dye-fixing material according to the present invention. Further, carrageenans described in EP-A-443529, and latexes having a glass transition temperature of 40° C or less described in JP-B-3-74820 may be preferably used.

The dye-fixing material may optionally have, if desired, auxiliary layers such as a protective layer, a peeling layer, an undercoating layer, an intermediate layer, a backing layer and a curling preventing layer. In particular, provision of a protective layer is helpful.

The layers constituting the heat-developable light-sensitive material and the dye-fixing material of the present invention may contain a plasticizer, a slipping agent as well as a high boiling point organic solvent as an agent for improving peelability between the light-sensitive material and the dye-fixing material. Usable of such materials are those described in JP-A-62-245253.

In addition, for the above-mentioned purposes, various silicone oils (including all silicone oils from dimethylsilicone oil to modified silicone oils formed by introducing various organic groups into dimethylsiloxane) can be used. As examples thereof, usable are various modified silicone oils as described in the technical reference Modified Silicone Oils (published by Shin-Etsu Silicone Co.), page 6–18B. Of them, especially effective is a carboxy-modified silicone (X-22-3710, trade name).

In addition, also effective are the silicone oils described in JP-A-62-215953 and JP-A-63-46449.

The heat-developable light-sensitive material and dye-fixing material can contain an anti-fading agent. Such an anti-fading agent includes an antioxidant, an ultraviolet absorbent as well as various kinds of metal complexes. Further, the dye image stabilizer and ultraviolet absorbent described in the above-described RDs may be used.

Examples of the antioxidant include chroman compounds, coumaran compounds, phenol compounds (e.g., hindered phenols), hydroquinone derivatives, hindered amine derivatives and spiroindane compounds. The compounds described in JP-A-61-159644 are also effective.

Examples of the ultraviolet absorbent include benzotriazole compounds (U.S. Pat. No. 3,533,794), 4-thiazolidone compounds (U.S. Pat. No. 3,352,681), benzophenone compounds (JP-A-46-2784) and other compounds as described in JP-A-54-48535, JP-A-62-136641 and JP-A-61- 8256. Further, ultraviolet-absorbing polymers described in JP-A-62-260152 are also effective.

Examples off the metal complexes include compounds described in U.S. Pat. Nos. 4,241,155, 4,245,018 (columns 3 to 36) and 4,254,195 (columns 3 to 8), JP-A-62-174741, JP-A- 61-88256 (pages 27 to 29), JP-A-63-199248, JP-A-1-75568 and JP-A-1-74272.

The anti-fading agent for preventing the dye as transferred to the dye-fixing material from fading may previously be incorporated into the dye-fixing material or, alternatively, it may be supplied to the dye-fixing material from an external source such as a light-sensitive material containing the agent.

The above-mentioned antioxidant, ultraviolet absorbent and metal complex can be employed in the present invention in the form of a combination thereof.

The heat-developable light-sensitive material and the dye-fixing material can contain a brightening agent. In particular, it is preferred to incorporate a brightening agent in the dye-fixing element or to supply the same to the said element from an external source such as a light-sensitive element containing the agent. As examples of the agent, compounds as described in K. Veenkataraman, *The Chemistry of Synthetic Dyes*, Vol. V, Chap. 8, and JP-A-61-143752 can be mentioned. Specifically, there can be mentioned stilbene compounds, coumarin compounds, biphenyl compounds, benzoxazolyl compounds, naphthalimide compounds, pyrazoline compounds and carbostyryl compounds.

The brightening agent can be employed in combination with the anti-fading agent or the ultraviolet absorbent.

Examples of the anti-fading agent, the ultraviolet absorbent and the brightening agent are described in JP-A-62-215272, pages 125 to 137 and JP-A-1-161236, pages 17 to 43.

The layers constituting the heat-developable light-sensitive material and the dye-fixing material can contain a hardening agent. Examples thereof are hardening agents described in the above-described RDs, U.S. Pat. Nos. 4,678,739 (column 41), 4,791,042 and JP-A-59-116655, JP-A-62-245261, JP-A-61-18942 and JP-A-4-218044. Specific examples include aldehyde hardening agents (e.g., formaldehyde), aziridine hardening agents, epoxy hardening agents, vinylsulfone hardening agents (e.g., N,N' -ethylene-bis(vinylsulfonylacetamide)ethane), N-methylol hardening agents (e.g., dimethylolurea) and high polymer hardening agents (e.g., compounds described in JP-A-62- 234157).

Such a hardening agent is preferably used in an amount of from 0.001 g to 1 g, more preferably 0.005 g to 0.5 g, per one g of gelatin coated. The hardening agent may be incorporated in any of the layers constituting the light-sensitive material or dye-fixing material or may be separately incorporated in two or more layers.

The layers constituting the heat-developable light-sensitive material or dye-fixing material may comprise various fog inhibitors, photographic stabilizers, or precursors thereof. Specific examples of these compounds are described in the above cited RDs, U.S. Pat. Nos. 5,089,378, 4,500,627, 4,614,702, JP-A-64-13546, pages 7 to 9, pages 57 to 71, pages 81 to 97, U.S. Pat. Nos. 4,775,610, 4,626,500, 4,983,494, JP-A-62-174747, JP-A-62- 239148, JP-A-63-264747, JP-A-1-150135, JP-A-2-110557, JP-A-2-178650, and RD 17643 (1978), pages 24 to 25.

These compounds are preferably used in an amount of $5\times10^{-6}$ to $1\times10^{-1}$ mol, more preferably $1\times10^{-5}$ to $1\times10^{-2}$ mol, per mol of silver.

The layers constituting the light-sensitive material and the dye-fixing material of the present various invention can contain various surfactants for purposes of aiding coating, improvement of the peeling property, improvement of the sliding property, prevention of static charge and enhancement of developability. Specific examples of such surfactants are described in JP-A-62-173463 and JP-A-62-183457.

The layers constituting the light-sensitive material and the dye-fixing material of the present invention can contain organic fluorine compounds for the purpose of an improvement of the sliding property, prevention of static charge and improvement of the peeling property. Specific examples of such organic fluorine compounds include fluorine surfactants described in JP-B- 57-9053 (columns 8 to 17) and JP-A-61-20944 and JP-A-62- 135826, as well as hydrophobic fluorine compounds such as fluorine oils and like oily fluorine compounds and ethylene tetrafluoride resins and like solid fluorine compound resins.

The light-sensitive material and the dye-fixing material can contain a matting agent. Examples of the matting agent include silicon dioxide and compounds described in JP-A-61-88256 (page 29) such as polyolefins or polymethacrylates, as well as compounds described in JP-A-63-274944 and JP-A-63-274952, such as benzoguanamine resin beads, polycarbonate resin beads and AS (acrylo-nitrile-styrene) resin beads. In addition, compounds described in the above-described RD are used. These matting agents can be added into not only the uppermost layer (protective layer) but also lower layer(s) if necessary.

In addition, the layers constituting the light-sensitive element and the dye-fixing element may further contain a thermal solvent, a defoaming agent, a microbicidal and fungitidal agent, colloidal silica and other additives. Examples of such additives are described in JP-A-61-88256 (pages 26 to 32), JP-A-3-11338 and JP-B-2- 51486.

In accordance with the present invention, the heat-developable light-sensitive material and/or the dye-fixing material can contain an image formation accelerator. Useful image formation accelerators include those which promote a redox reaction between a silver salt oxidizing agent and a reducing agent, those which promote the reactions of forming a dye from a dye-donating substance or decomposing a dye or releasing a diffusible dye, and those which promote the migration of a dye from the heat-developable light-sensitive layer to the dye-fixing layer. Classified by physicochemical function, the image formation accelerators can be classified into bases or base precursors, nucleophilic compounds, high boiling point organic solvents (oils), thermal solvents, surfactants and compounds which interact with silver or silver ions, for instance. However, each of these substances generally has plural functions and provides several of the above-mentioned effects. A detailed discussion on these substances can be found in U.S. Pat. No. 4,678,739 at columns 38 to 40.

As the base precursor, there can be mentioned salts between an organic acid which may be decarboxylated under heat and a base, as well as compounds capable of releasing an amine by an intramolecular nucleophilic substitution reaction, Rossen rearrangement or Beckmann rearrangement. Specific examples thereof are described in U.S. Pat. Nos. 4,511,493 and 4,657,848.

In the system where heat-development and dye transfer are effected simultaneously in the presence of a small amount of water, it is preferred to incorporate the base and/or base precursor in the dye-fixing material for the purpose of improving the storage stability of the heat-developable light-sensitive material.

In addition, the combination of a hardly soluble metal compound and a compound capable of complexing with the metal ion which constitutes the hardly soluble metal compound (hereinafter referred to as a "complex-forming compound") described in EP-A-210660, U.S. Pat. No. 4,740,445; as well as compounds yielding a base by electrolysis described in JP-A-61-232451 can also be used as the base precursor. Use of the former is especially effective. The hardly soluble metal compound and the complex-forming compound are advantageously separately added to different heat-developable light-sensitive material and dye-fixing material as described in the above references.

The heat-developable light-sensitive material and/or the dye-fixing material of the present invention can contain various development terminating agents for the purpose of always obtaining constant images despite fluctuations in the development temperature and the processing time for development.

The terminology "development terminating agent" as used herein means a compound which, after proper development, quickly neutralizes a base or reacts with a base to lower the base concentration in the layer in which the base is present and thereby terminates the development, or a compound which interacts with silver or a silver salt to arrest development. Specifically, there can be mentioned acid precursors which release an acid under heat, electrophilic compounds which react with the existing base by a substitution reaction under heat, as well as nitrogen-containing heterocyclic compounds, mercapto compounds and precursors thereof. More precisely, specific examples of these compounds are described in JP-A- 62-253159 (pages 31 and 32).

The support which is employed in preparing the heat-developable light-sensitive material and the dye-fixing material of the present invention may be any support that withstands the processing temperature. In general, paper and synthetic high polymer films, such as described in *Bases of Photographic Engineering,* Edition of Silver Photography, pages 223 to 240 (published by Corona Publishing Co., Ltd., Japan, 1979), are used as the support. Specifically, the support includes films of polyethylene terephthalate (PET), polycarbonates, polyvinyl chloride, polystyrene, polypropylene, polyimide, celluloses (e.g., triacetyl cellulose) and those films containing a pigment such as titanium oxide; synthetic paper made of polypropylene by a filming method; mixed paper made of a synthetic resin pulp (e.g., polyethylene) and a natural pulp; as well as Yankee paper, baryta paper, coated paper (especially cast-coated paper), metals, cloth and glass.

These supports may be used directly as they are or may be used in the form as coated with a synthetic high polymer substance (e.g., polyethylene) on one surface or both surfaces thereof. The coated layer may contain pigments or dyes such as titanium oxide, ultramarine and carbon black, if necessary.

In addition, supports described in JP-A-62-253159, pages 29 to 31, JP-A-1-161236, pages 14 to 17, JP-A-63- 316848, JP-A-2-22651, JP-A-3-56955 and U.S. Pat. No. 5,001,033 can also be employed in the present invention.

The surface of the support may be coated with a hydrophilic binder and a semiconductive metal oxide (e.g., an alumina sol or tin oxide) or an antistatic agent such as carbon black. Specifically, supports described in JP-A- 62-220246 can also be used.

The surface of the support is preferably subjected to various surface treatment or coating treatment in order to improve adhesivity to a hydrophilic binder.

For imagewise exposing and recording an image on the heat-developable light-sensitive material of the present invention, various methods can be employed, which include, for example, a method of directly photographing a scene or man with a camera; a method of exposing an image through a reversal film or negative film by the use of a printer or an enlarger; a method of scanning and exposing an original through a slit by the use of an exposing device of a duplicator; a method of exposing image information via a corresponding electric signal by emitting the same with an emitting diode or various lasers (e.g., laser diode, gas laser) as described in JP-A-2- 129625, JP-A-5-176144, JP-A-5-199372 and JP-A-6-127021; and a method of outputting image information with an image display device such as a CRT, liquid crystal display, electroluminescence display or plasma display and then exposing the same directly or via some optical system.

As the light source used for recording an image on the light-sensitive material of the present invention, those as described in U.S. Pat. No. 4,500,626 (column 56), JP-A-2-53378 and JP-A-2-54672, such as natural light, a tungsten lamp, a light-emitting diode, laser rays and CRT rays can be employed, as mentioned above.

Further, a wavelength conversion element in which a nonlinear optical material is combined with a coherent light source such as laser can be used to effect imagewise exposure. The nonlinear optical material is a material capable of developing nonlinearity between polarization and electric field created when a strong photoelectric field such as laser light is given. Inorganic compounds such as lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and compounds described in JP-A-61-53462 and JP-A-62-210432. As wavelength conversion elements, single crystal light guide type wavelength conversion element, fiber type wavelength conversion element, and so on have been known. Any of these types of wavelength conversion elements can the effectively used.

As the above-described image information, any image signals obtained from a video camera or electronic still camera; television signals as standardized by the Nippon Television Signal Code (NTSC); image signals obtained by dividing an original into plural pixels with a scanner; and image signals formed by the use of a computer such as CG or CAD, can be employed.

The heat-developable light-sensitive material and/or dye-fixing material according to the present invention may have an electrically conductive heating element layer as a heating means for heat development and diffusion transfer of dye. In this embodiment, heating elements described in JP-A-61-145544 may be used.

The heating temperature in the heat-development step of the present invention may be from about 50° C to about 250° C. An especially useful temperature is from about 60° C to about 180° C. The step of diffusing and transferring the dye formed by development may be effected simultaneously with the heat-development step or after the same. In the latter case, the heating temperature in the transfer step may be from the temperature in the previous heat-development step to room temperature. Preferably, it is from 50° C to a temperature lower than the temperature in the heat-development step by about 10° C.

Migration of the dye formed may be effected only by heat, but a solvent may be used for the purpose of accelerating the migration of the dye. Further, as described in detail in U.S. Pat. Nos. 4,704,345 and 4,740,445 and JP-A-61-238056, a method where development and transfer are carried out in the presence of a small amount of a solvent (especially, water) under heating, either at the same time or in a continuous sequence, can be advantageously utilized. In this method, the heating temperature is preferably from 50° C to the boiling point of the solvent used. For instance, when the solvent is water, the temperature is desirably from 50° C to 100° C.

Examples of the solvents used for the acceleration of development and/or transfer of the diffusible dye include water and an aqueous basic solution containing an inorganic alkali metal salt or an organic base. As the bases, those mentioned hereinbefore as image formation accelerators can be employed. In addition, a low boiling point solvent or a mixed solvent comprising a low boiling point solvent and[ water or an aqueous basic solution can also be used. Further, surfactants, antifoggants, complex-forming compounds with hardly soluble metals, an antiputrefaction agent, and an antimicrobial agent can be incorporated into the solvents.

As the solvent to be used in these heat-developing and diffusion-transferring steps, water is preferred. As water, any ordinary water may be employed. For example, concretely mentioned are distilled water, city tap water, well water, and mineral water. In the heat-developing device to be used for processing the heat-developable material of the present invention along with dye-fixing material, water once used may be drained off or may be circulated through the device for recycle use. In the latter case, water to be circulated and re-used contains chemicals dissolved out from the processed materials. In addition, devices and water described in JP-A-63-144354, JP-A-63-144355, JP-A-62-38460, and JP-A-3-210555 can also be used in processing the light-sensitive materials of the present invention.

The solvent can be applied to either or both of the heat-developing light-sensitive material and the dye-fixing material. The amount of the solvent to be applied may be equal to or less than the weight of the solvent corresponding to the maximum swollen volume of all the coated layers.

To apply water to the material, for example, preferably employable are methods described in JP-A-62- 253159, page 5 and JP-A-63-85544. If desired, the solvent to be applied may be encapsulated in microcapsules or may be incorporated into the heat-developable light-sensitive material and/or the dye-fixing material as its hydrate.

The temperature of water to be applied may fall within the range between room temperature and 60° C, as so described in the above-mentioned JP-A-63-85544. In particular, the temperature is preferably 45° C or higher in order to prevent harmful microbes from growing in water.

In order to accelerate the migration of the dye formed, a system of incorporating a hydrophilic thermal solvent which is solid at room temperature but which can melt at a high temperature into the light-sensitive material or into the dye-fixing material may also be employed in the present invention. In employing this system, the hydrophilic thermal solvent may be incorporated into either the light-sensitive material or the dye-fixing material or into both of them. The layer to which the solvent is added may be any of the light-sensitive silver halide emulsion layer, interlayer, protective layer and dye-fixing layer, but the solvent is preferably added to the dye-fixing layer and/or layer(s) adjacent thereto.

Examples of the thermal solvent to be employed in such a system include ureides, pyridines, amides, sulfonamides, imides, alcohols, oximes and other heterocyclic compounds.

For heating the materials in the development step and/or the transfer step, they may be kept in contact with a heated block or plate, or with a hot plate, hot presser, hot roller, halogen lamp heater or infrared or farinfrared lamp heater or may be passed through a high temperature atmosphere.

When the light-sensitive material is attached to the dye-fixing material, methods described in JP-A-62- 253159 and JP-A-61-147244 (page 27) are applicable.

For processing the photographic elements of the present invention, any general heat-developing apparatus can be utilized. For instance, apparatus described in JP-A-59-75247, JP-A-59-177547, JP-A-59-181353 and JP-A-60-18951, JU-A-62-25944, Japanese Patent Application Nos. 4-277517, 4-243072 and 4-244693 are preferably employed (the term "JU-A" as used herein means an "examined Japanese utility application"). Examples of commercially available heat developing apparatus include Pictrostat 100, Pictrostat 200, Pictrography 2000 and Pictrography 3000 produced by Fuji Photo Film Co., Ltd.

The present invention will be explained in more detail with reference to the following examples, which, however, are not intended to restrict the scope of the present invention.

EXAMPLE 1

Preparation of a dispersion of zinc hydroxide

A dispersion of zinc hydroxide was prepared by adding 12.5 g of zinc: hydroxide having a mean grain size of 0.2 μm, 1 g of carboxymethyl cellulose as a dispersing agent, and 0.1 g of sodium polyacrylate to 100 ml of an aqueous 4% gelatin solution and grinding them in a mill with glass beads having a mean grain size of 0.75 mm for 30 minutes. The glass beads were separated to obtain a dispersion of zinc hydroxide.

Preparation of a dispersion of an electron transferring agent

A dispersion elf an electron transferring agent was prepared by adding 10 g of the following electron-transferring agent, 0.5 g of polyethylene glycol nonylphenyl ether as a dispersing agent, and 0.5 g of anionic surfactant (1) to 100 ml of an aqueous 5% gelatin solution and grinding them in a mill with glass beads having a mean grain size of 0.75 mm for 60 minutes. The glass beads were separated to obtain a dispersion of electron-transferring agent having a mean grain size of 0.35 μm.

Electron-Transferring Agent:

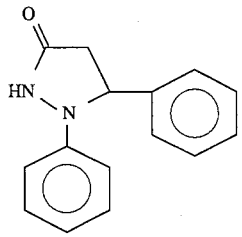

Anionic Surfactant (1):

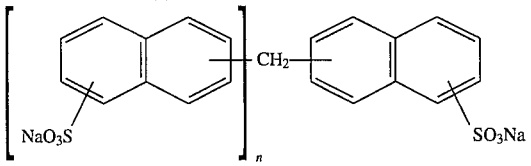

Preparation of a dispersion of a dye trapping agent

While stirring a mixture comprising 108 ml of the following polymer late:< (solids content: 13%), 20 g of the following surfactant and 1232 ml of water, 600 ml of an aqueous 5% solution of anionic surfactant (2) was added thereto over a period of 10 minutes. The dispersion thus prepared was concentrated to 500 ml and desalted through an ultrafilter module. Next, 1500 ml of water was added thereto, and the same operation was again repeated. Thus, 500 g of a dye trapping agent dispersion was obtained.

Polymer Latex:

-continued

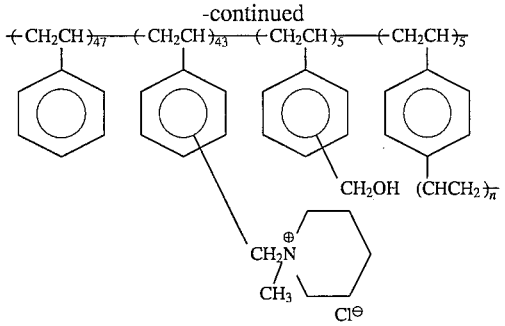

Surfactant:

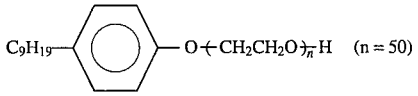

Anionic Surfactant (2):

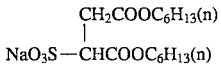

Preparation of gelatin dispersions of hydrophobic additives

Individual gelatin dispersions of cyan, magenta, yellow and electron donors were prepared, each having the formulation shown in Table 1. Briefly, the components of the oily phase were dissolved under heat at about 60° C to form a uniform solution, and the solution was blended and stirred with the components of the aqueous phase as heated at about 60° C. The resulting mix was then dispersed in a homogenizer for 13 minutes at 12,000 rpm. Water of a predetermined amount was added thereto to obtain a uniform dispersion.

TABLE 1

| Dispersion | Compound | Cyan | Magenta | Yellow | Electron Donor |
|---|---|---|---|---|---|
| Oily phase | Dye-Donating Compound (1) | 9.05 g | — | — | — |
| | Dye-Donating Compound (2) | 6.19 g | — | — | — |
| | Dye-Donating Compound (3) | — | 15.5 g | — | — |
| | Dye-Donating Compound (4) | — | — | 9.1 g | — |
| | Electron Donor (1) | 4.84 g | 5.61 g | 2.3 g | — |
| | Electron Donor (2) | — | — | — | 13.87 g |
| | Restrainer-Releasing Redox Compound (1) | — | — | — | 2.62 g |
| | Electron-Transferring Agent Precursor | 1.42 g | 1.42 g | 0.86 g | — |
| | Compound (1) | 0.40 g | 0.44 g | 0.40 g | — |
| | Compound (2) | 1.53 g | 1.94 g | — | — |
| | Compound (3) | 1.52 g | 1.94 g | — | — |
| | High Boiling Point Solvent (1) | 1.91 g | 1.94 g | 5.20 g | — |
| | High Boiling Point Solvent (2) | 5.72 g | 5.81 g | — | 2.93 g |
| | High Boiling Point Solvent (3) | — | — | — | 2.94 g |
| | Surfactant (1) | 1.55 g | 0.52 g | 1.50 g | 0.45 g |
| | Ethyl Acetate | 34.5 ml | 34.5 ml | 25.0 ml | 18.0 ml |
| | Methyl Ethyl Ketone | 47.5 ml | 47.5 ml | — | — |
| Aqueous Phase | Lime-Processed Gelatin | 10.0 g | 10.0 g | 10.0 g | 10.0 g |
| | Citric Acid | — | — | 0.14 g | 0.14 g |
| | Sodium Hydrogensulfite | — | — | — | 0.15 g |
| | Water | 150 ml | 150 ml | 120 ml | 97 ml |
| | Water added | 150 ml | 160 ml | 125 ml | 61 ml |

Dye-Donating Compound (1):

TABLE 1-continued
| Dispersion | Compound | Cyan | Magenta | Yellow | Electron Donor |
|---|---|---|---|---|---|
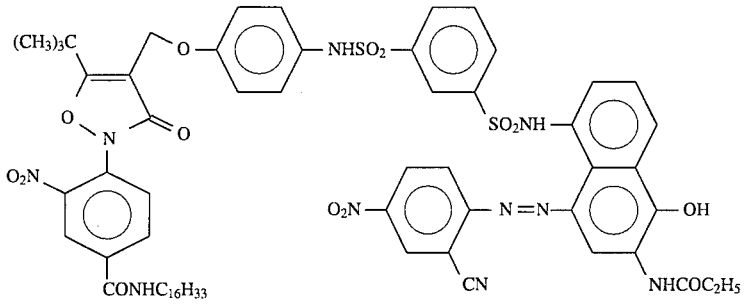
Dye-Donating Compound (2):
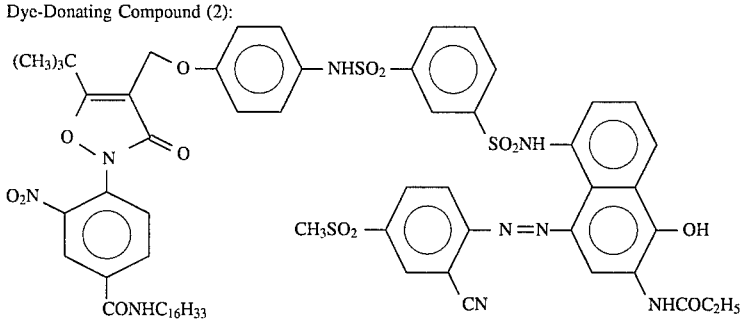
Dye-Donating Compound (3):
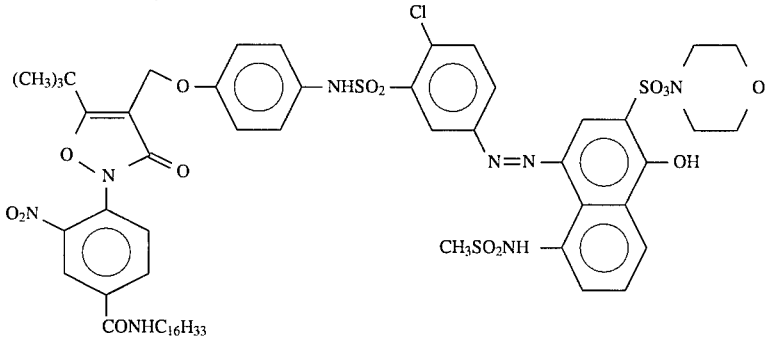
Dye-Donating Compound (4):
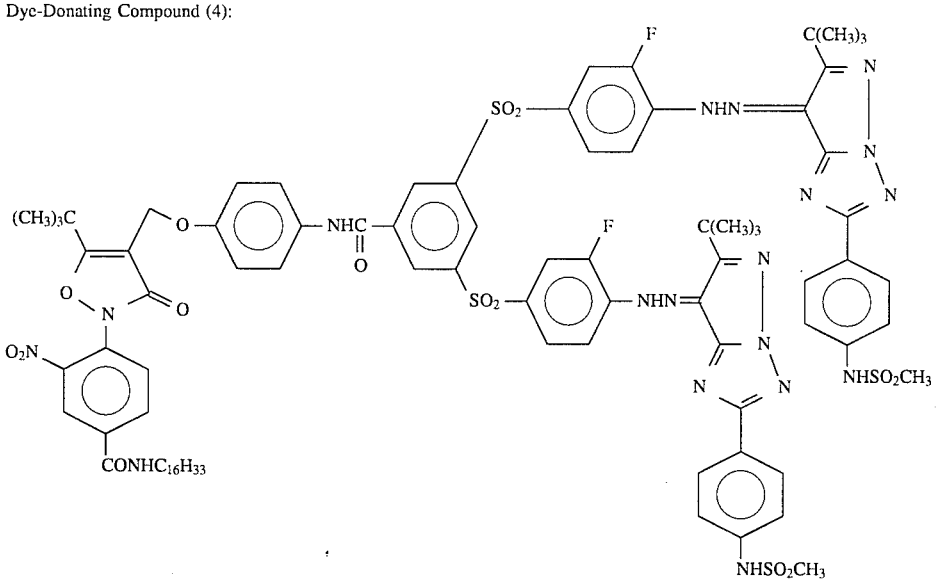
Electron Donor (1):

TABLE 1-continued
| Dispersion | Compound | Cyan | Magenta | Yellow | Electron Donor |
|---|---|---|---|---|---|
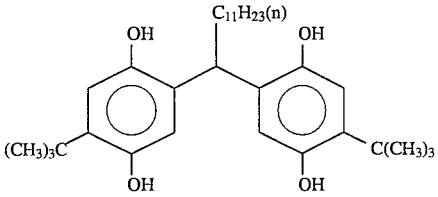
Electron Donor (2):
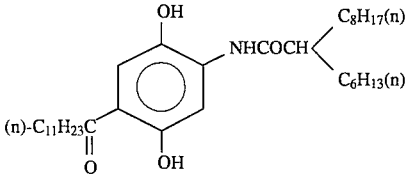
Restrainer-Releasing Redox Compound (1):
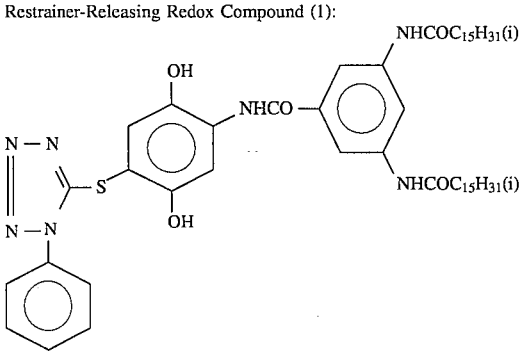
Electron-Transferring Agent Precursor:
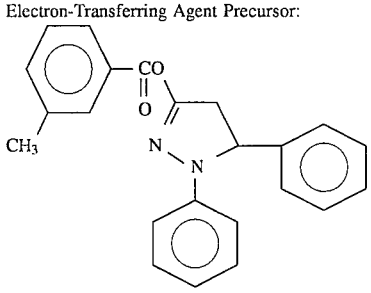
Compound (1):
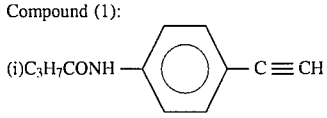
Compound (2):
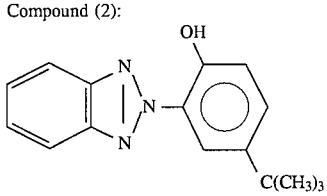
Compound (3):
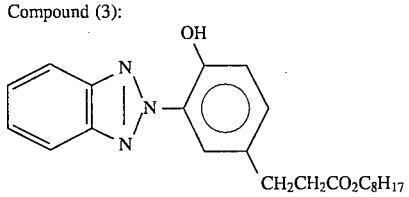

TABLE 1-continued

| Dispersion | Compound | Cyan | Magenta | Yellow | Electron Donor |
|---|---|---|---|---|---|

High Boiling Point Solvent (1):

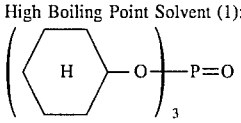

High Boiling Point Solvent (2):

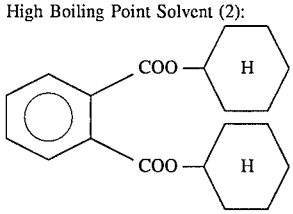

High Boiling Point Solvent (3):

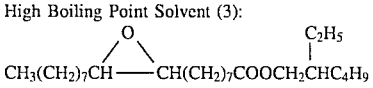

Surfactant (1):

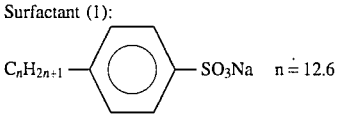

Preparation of light-sensitive silver halide emulsions

Light-Sensitive Silver Halide Emulsion (1) (for red-sensitive emulsion layer):

Solution (I) and solution (II) shown in Table 2 were simultaneously added to a well stirred aqueous gelatin solution (prepared by adding 20 g of gelatin, 0.5 g of potassium bromide, 3 g of sodium chloride and 30 mg of chemical substance (A) to 500 ml of water and then keeping at 45° C), over a period of 20 minutes at the same flow rate for each solution. After 5 minutes, solution (III) and solution (IV) also shown in Table 2 were simultaneously added thereto over a period of 25 minutes at the same flow rate. Ten minutes after initiation of the addition of solution (III) and solution (IV), an aqueous solution of a gelatin dispersion of dyes (containing 1 g of gelatin, 70 mg of dye (a), 139 mg of dye (b) and 5 mg of dye (c) in 105 ml of water and kept at 45° C) was added to the system over a period of 20 minutes.

The resulting product was rinsed with water and desalted by a conventional method, and 22 g of lime-processed ossein gelatin was added thereto, and the pH of the system was adjusted to be 6.2 with the pAg thereof adjusted to 7.8. The resulting product was subjected to optimum chemical sensitization at 68° C, by adding 4-hydroxy- 6-methyl-1,3,3a, 7-tetrazaindene, sodium thiosulfate and chloroauric acid thereto, and was cooled after adding the following antifoggant (2). Thus, 635 g of a monodisperse cubic silver chlorobromide emulsion having a mean grain size of 0.30 μm was obtained. Chemical Substance (A):

TABLE 2

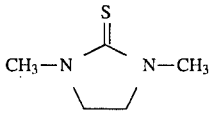

| | Solution (I) | Solution (II) | Solution (III) | Solution (IV) |
|---|---|---|---|---|
| $AgNO_3$ | 50.0 g | — | 50.0 g | — |
| $NH_4NO_3$ | 0.19 g | — | 0.19 g | — |
| KBr | — | 28.0 g | — | 35.0 g |
| NaCl | — | 3.45 g | — | — |
| | Water to make 250 ml | Water to make 250 ml | Water to make 200 ml | Water to make 200 ml |

Dye (a):

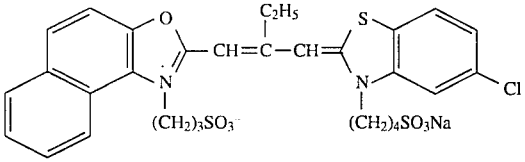

Dye (b):

TABLE 2-continued

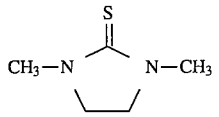

| Solution (I) | Solution (II) | Solution (III) | Solution (IV) |
|---|---|---|---|

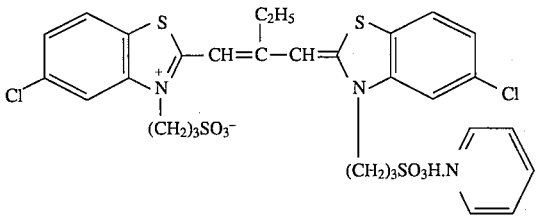

Dye (c):

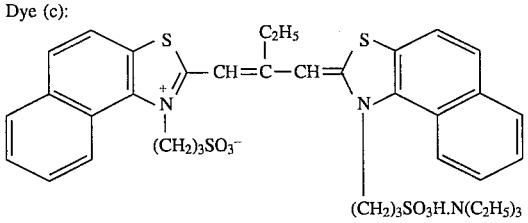

Light-Sensitive Silver Halide Emulsion (2) (for red-sensitive emulsion layer):

Solution (I) and solution (II) shown in Table 3 were simultaneously added to a well stirred aqueous gelatin solution (prepared by adding 20 g of gelatin, 0.5 g of potassium bromide, 6 g of sodium chloride and 30 mg of chemical substance. (A) to 800 ml of water and keeping at 65° C), over a period of 30 minutes at the same flow rate. After 5 minutes, solution (III) and solution (IV) also shown in Table 3 were simultaneously added thereto over a period of 15 minutes at the same flow rate. Two minutes after initiation of the addition of solution (III) and solution (IV), an aqueous solution of a gelatin dispersion of dyes (containing 1.1 g of gelatin, 76 mg of dye (a), 150 mg of dye (b) and 5 mg of dye (c) in 95 ml of water and keeping at 50° C) was added to the system over a period of 18 minutes.

The resulting product was rinsed with water and desalted by a conventional method, and 22 g of lime-processed ossein gelatin was added thereto, and the pH thereof was adjusted to 6.2 with the pAg thereof adjusted to 7.8. This product was then subjected to optimum chemical sensitization at 60° C, by adding 4-hydroxy-6 -methyl-1,3,3a,7-tetrazaindene, sodium thiosulfate and chloroauric acid thereto, and was cooled after adding the following antifoggant (1). Thus, 635 g of a monodisperse cubic silver chlorobromide emulsion having a mean grain size of 0.50 μm was obtained.

TABLE 3

| | Solution (I) | Solution (II) | Solution (III) | Solution (IV) |
|---|---|---|---|---|
| $AgNO_3$ | 50.0 g | — | 50.0 g | — |
| $NH_4NO_3$ | 0.19 g | — | 0.19 g | — |
| KBr | — | 28.0 g | — | 35.0 g |
| NaCl | — | 3.45 g | — | — |
| | Water to make 200 ml | Water to make 140 ml | Water to make 145 ml | Water to make 155 ml |

Light-Sensitive Silver Halide Emulsion (3) (for green-sensitive emulsion layer):

Solution (I) and solution (II) shown in Table 4 below were simultaneously added to a well stirred aqueous gelatin solution (prepared by adding 20 g of gelatin, 0.5 g of potassium bromide, 4 g of sodium chloride and 15 mg of chemical substance (A) to 690 ml of water and keeping at 47° C), over a period of 8 minutes at the same flow rate. After 10 minutes, solution (III) and solution (IV) also shown in Table 4 were simultaneously added thereto over a period of 32 minutes at the same flow rate. One minute after the addition of solution (III) and solution (IV), an aqueous solution of a gelatin dispersion of a dye (containing 3.5 g of gelatin and 250 mg of dye (d) in 100 ml of water and keeping at 45° C) was added to the system all at one time.

The resulting product was rinsed with water and desalted by a conventional method, and 20 g of lime-processed ossein gelatin was added thereto, the pH thereof being adjusted to be 6.0 with the pAg thereof adjusted to 7.6. The resulting product was then subjected to optimum chemical sensitization at 68° C, by adding 4-hydroxy-6 -methyl-1,3,3a,7-tetrazaindene and sodium thiosulfate, and was cooled after adding antifoggant (1). As a result, 635 g of a monodisperse cubic silver chlorobromide emulsion having a mean grain size of 0.27 μm was obtained.

TABLE 4

| | Solution (I) | Solution (II) | Solution (III) | Solution (IV) |
|---|---|---|---|---|
| $AgNO_3$ | 20.0 g | — | 80.0 g | — |
| $NH_4NO_3$ | 0.13 g | — | 0.38 g | — |
| KBr | — | 9.8 g | — | 44.8 g |
| NaCl | — | 2.06 g | — | 5.51 g |
| | Water to make 110 ml | Water to make 110 ml | Water to make 245 ml | Water to make 245 ml |

Dye (d):

TABLE 4-continued

| Solution (I) | Solution (II) | Solution (III) | Solution (IV) |
|---|---|---|---|

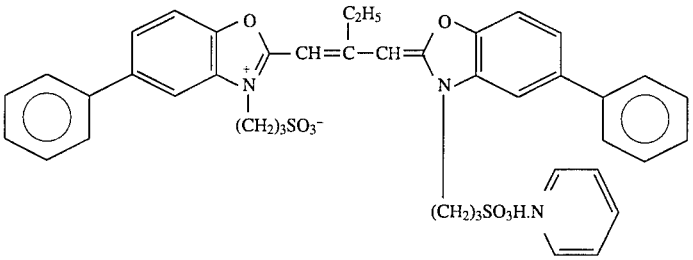

Light-Sensitive Silver Halide Emulsion (4) (for green-sensitive emulsion layer):

Solution (I) and solution (II) shown in Table 5 below were simultaneously added to a well stirred aqueous gelatin solution (prepared by adding 20 g of gelatin, 0.3 g of potassium bromide,. 6 g of sodium chloride and 15 mg of chemical substance (A) to 700 ml of water and keeping at 60° C), over a period of 20 minutes at the same flow rate. After 10 minutes, solution (III) and solution (IV) also shown in Table 5 were simultaneously added thereto over a period of 20 minutes at the same flow rate. One minute after the addition of solution (III) and solution (IV), an aqueous solution of a gelatin dispersion of a dye (containing 1.8 g of gelatin and 180 mg of dye (d) in 75 ml of water and keeping at 45° C) was added to the system all at one time.

The resulting product was rinsed with water and desalted by a conventional method, and 20 g of lime-processed ossein gelatin was added thereto, and the pH thereof was adjusted to 6.0 with the pAg thereof adjusted to 7.7. The resulting product was the subjected to optimum chemical sensitization at 68° C, by adding 4 -hydroxy-6-methyl-1,3,3a,7-tetrazaindene and sodium thiosulfate thereto. Thus, 635 g of a monodisperse cubic silver chlorobromide emulsion having a mean grain size of 0.45 μm was obtained.

TABLE 5

| | Solution (I) | Solution (II) | Solution (III) | Solution (IV) |
|---|---|---|---|---|
| $AgNO_3$ | 20.0 g | — | 80.0 g | — |
| $NH_4NO_3$ | 0.19 g | — | 0.38 g | — |
| KBr | — | 9.8 g | — | 44.8 g |
| NaCl | — | 2.06 g | — | 5.5 g |
| | Water to make 165 ml | Water to make 165 ml | Water to make 205 ml | Water to make 205 ml |

Light-Sensitive Silver Halide Emulsion (5) (for blue-sensitive emulsion layer):

Solution (I) and solution (II) shown in Table 6 below were simultaneously added to a well stirred aqueous gelatin solution (prepared by adding 20 g of gelatin, 0.5 g of potassium bromide,. 4 g of sodium chloride and 15 mg of chemical substance (A) to 690 ml of water and keeping at 52° C), over a period of 8 minutes at the same flow rate. After 10 minutes;, solution (I! I) and solution (IV) also shown in Table 6 were simultaneously added thereto over a period of 32 minutes at the same flow rate. One minute after the addition of solution (III) and solution (IV), an aqueous solution of dyes (containing 235 mg of dye (e) and 120 mg of dye (f) in 95 ml of water and 5 ml of methanol and keeping at 45° C) was added to the system all at one time.

The resulting product was rinsed with water and desalted by a conventional method, and 22 g of lime-processed ossein gelatin was added thereto, and the pH thereof was adjusted to 6.0 with the pAg thereof adjusted to 7.7. The resulting product was then subjected to optimum chemical sensitization at 68° C, by adding 4-hydroxy- 6-methyl-1,3,3a,7-tetrazaindene and sodium thiosulfate thereto. Thus, 635 g of a monodisperse cubic silver chlorobromide emulsion having a mean grain size of 0.30 μm was obtained.

TABLE 6

| | Solution (I) | Solution (II) | Solution (III) | Solution (IV) |
|---|---|---|---|---|
| $AgNO_3$ | 20.0 g | — | 80.0 g | — |
| $NH_4NO_3$ | 0.13 g | — | 0.38 g | — |
| KBr | — | 9.8 g | — | 44.8 g |
| NaCl | — | 2.06 g | — | 5.52 g |
| $K_2IrCl_4$ | — | 0.03 mg | — | — |
| | Water to make 110 ml | Water to make 110 ml | Water to make 240 ml | Water to make 240 ml |

Dye (e):

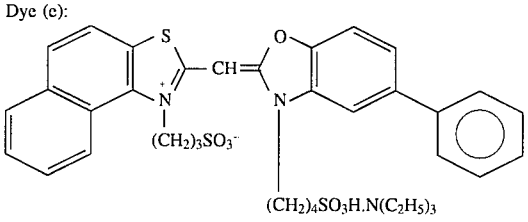

Dye (f):

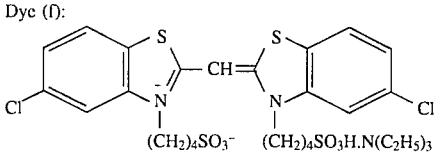

Light-Sensitive Silver Halide Emulsion (6) (for blue-sensitive emulsion layer):

Solution (I) and solution (II) shown in Table 7 below were simultaneously added to a well stirred aqueous gelatin solution (prepared by adding 20 g of gelatin, 0.3 g of potassium bromide, 9 g of sodium chloride and 15 mg of chemical substance (A) to 695 ml of water and keeping at 65° C), over a period of 10 minutes at the same flow rate. After 10 minutes, solution (III) and solution (IV) also shown in Table 7 were simultaneously added thereto over a period of 30 minutes at the same flow rate. One minute after the addition of solution (III) and solution (IV), an aqueous solution of dyes (containing 155 mg of dye (e) and 78 mg of dye (f) in 66 ml of water and 4 ml of methanol and keeping at 60° C) was added to the system all at one time.

The resulting product was rinsed with water and desalted by a conventional method, and 22 g of lime-processed ossein gelatin was added thereto, and pH of this was adjusted to be 6.0 with pAg thereof to 7.7. The resulting product was then subjected to optimum chemical sensitization at 68° C, by adding 4-hydroxy-6-methyl- 1,3,3a,7-tetrazaindene and sodium thiosulfate thereto. Thus, 635 g of a monodisperse cubic silver chlorobromide emulsion having a mean grain size of 0.52 μm was obtained.

TABLE 7

| | Solution (I) | Solution (II) | Solution (III) | Solution (IV) |
|---|---|---|---|---|
| $AgNO_3$ | 25.0 g | — | 75.0 g | — |
| $NH_4NO_3$ | 0.13 g | — | 0.37 g | — |
| KBr | — | 12.3 g | — | 42.0 g |
| NaCl | — | 2.58 g | — | 5.18 g |
| $K_2IrCl_4$ | — | 0.02 mg | — | — |
| | Water to make 120 ml | Water to make 120 ml | Water to make 225 ml | Water to make 225 ml |

Using the above materials, light-sensitive material sample No. 101 having the constitution shown in Table 8 was prepared.

TABLE 8

Constitution of Light-Sensitive Material Sample No. 101

| Layer No. | Layer Name | Components | Amount Coated ($mg/m^2$) |
|---|---|---|---|
| 7th Layer | Protective Layer II | Acid-Processed Gelatin | 340 |
| | | PMMA Latex (size: 3 μm) | 20 |
| | | Colloidal Silica | 0.7 |
| | | Surfactant (1) | 8 |
| | | Fluorine Surfactant | 2 |
| | | Calcium Nitrate | 4 |
| 6th Layer | Protective Layer I | Lime-Processed Gelatin | 410 |
| | | Zinc Hydroxide | 440 |
| | | Electron Donor | 75 |
| | | Restrainer-Releasing Redox Compound (1) | 14 |
| | | High Boiling Point Solvent (3) | 16 |
| | | High Boiling Point Solvent (4) | 16 |
| | | Dextran | 16 |
| | | Water-Soluble Polymer (1) | 1.4 |
| | | Polymer Latex (1) | 47 |
| | | Surfactant (3) | 28 |
| | | Surfactant (1) | 4.5 |
| 5th Layer | Blue-Sensitive Emulsion Layer | Light-Sensitive Silver Halide Emulsion (5) | 315 (in terms of silver) |
| | | Light-Sensitive Silver Halide Emulsion (6) | 95 (in terms of silver) |
| | | Dye-Donating Compound (4) | 266 |
| | | Lime-Processed Gelatin | 520 |
| | | Electron Donor (1) | 61 |
| | | Electron-Transferring Agent Precursor Compound (1) | 25 |
| | | High-Boiling Point Solvent (1) | 11.7 |
| | | Surfactant (1) | 152 |
| | | Antifoggant (1) | 44 |
| | | Water-Soluble Polymer (1) | 0.9 |
| 4th Layer | Interlayer | Lime-Processed Gelatin | 11 |
| | | Electron Donor (2) | 550 |
| | | Restrainer-Releasing Redox Compound (1) | 159 |
| | | High-Boiling Point Solvent (3) | 30 |
| | | High Boiling point Solvent (4) | 34 |
| | | Surfactant (1) | 34 |
| | | Polymer Latex (1) | 5.1 |
| | | Electron-Transferring Agent | 62 |
| | | Dextran | 78 |
| | | Hardening Agent (1) | 38 |
| | | Surfactant (3) | 36 |
| | | Water-Soluble Polymer (1) | 26 |
| 3rd Layer | Green-sensitive Emulsion Layer | Light-Sensitive Silver Halide Emulsion (3) | 10 |
| | | Light-Sensitive Silver Halide Emulsion (4) | 250 (in terms of silver) |
| | | Dye-Donating Compound (3) | 100 (in terms of silver) |
| | | Lime-Processed Gelatin | 359 |
| | | Electron Donor (1) | 430 |
| | | Electron-Transferring Agent Precursor Compound (1) | 130 |
| | | Compound (2) | 33 |
| | | Compound (3) | 10 |
| | | High-Boiling Point Solvent (1) | 45 |
| | | High-Boiling Point Solvent (2) | 45 |
| | | Antifoggant (1) | 45 |
| | | Water-Soluble Polymer (1) | 135 |
| | | Surfactant (1) | 0.8 |
| 2nd Layer | Interlayer | Lime-Processed Gelatin | 13 |
| | | Zinc Hydroxide | 8 |
| | | Electron Donor (2) | 760 |
| | | Restrainer-Releasing Redox Compound (1) | 800 |
| | | High-Boiling Point Solvent (3) | 139 |
| | | High-Boiling Point Solvent (4) | 26 |
| | | Surfactant (1) | 29 |
| | | Dextran | 29 |
| | | Water-Soluble Polymer (1) | 4.5 |
| | | Polymer Latex (1) | 29 |
| | | Surfactant (3) | 3.0 |
| 1st Layer | Red-Sensitive Emulsion Layer | Light-Sensitive Silver Halide Emulsion (1) | 85 |
| | | Light-Sensitive Silver Halide Emulsion (2) | 54 |
| | | Dye-Donating Compound (1) | 108 (in terms of silver) |
| | | Dye-Donating Compound (2) | 60 (in terms of silver) |
| | | Lime-Processed Gelatin | 185 |
| | | Electron Donor (1) | 127 |
| | | Electron-Transferring Agent Precursor Compound (1) | 580 |
| | | Compound (2) | 100 |
| | | Compound (3) | 29 |
| | | High-Boiling Point Solvent (1) | 8.2 |
| | | High-Boiling Point Solvent (3) | 31 |
| | | Antifoggant (1) | 31 |
| | | Antifoggant (2) | 39 |
| | | Water-Soluble Polymer (1) | 117 |
| | | Surfactant (1) | 0.2 |
| | Support (1) | Polyethylene-Laminated Paper Support (Thickness: 131.2 μm) | 0.3 |
| | | | 7 |
| | | | 21 |

TABLE 8-continued

| Constitution of Support (1) | | |
|---|---|---|
| Layer Name | Components | Layer Thickness (μm) |
| Surface Undercoat Layer | Gelatin | 0.1 |
| Surface PE Layer (glossy) | Low Density Polyethylene (density 0.923): 89.2 parts; Surface-Processed Titanium Oxide: 10.0 parts | 36.0 |
| Pulp Layer | High Quality Paper (LBKP/NBKP = 1/1, density 1,080) | 64.0 |
| Back PE Layer (mat) | High Quality Polyethylene (density 0.960) | 31.0 |
| Back Undercoat Layer | Gelatin | 0.05 |
| | Colloidal Silica | 0.05 |
| | | 131.2 (total) |

Surfactant (2):

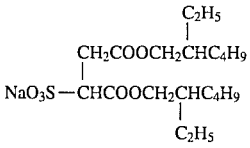

Fluorine Surfactant:

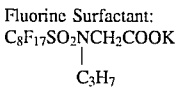

Surfactant (3):

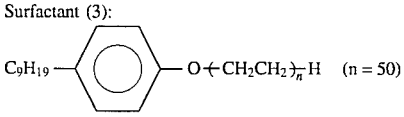

Antifoggant (1):

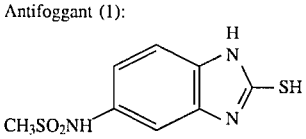

Antifoggant (2):

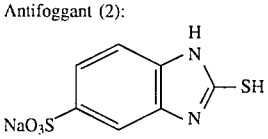

Water-Soluble Polymer (1):

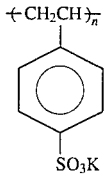

Hardening Agent (1):

$CH_2=CHSO_2CH_2SO_2CH=CH_2$

Polymer Latex (1):

TABLE 8-continued

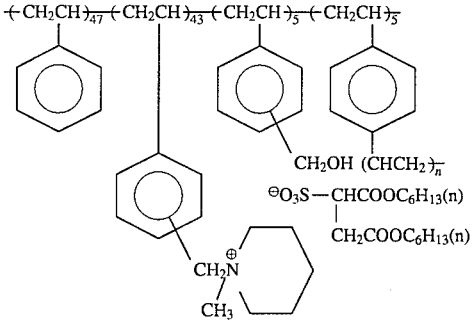

Next, the method for preparing dispersions of solid organic pigments is mentioned below.

Twenty g of pigment (27) of the present invention and 2.0 g of the above-mentioned surfactant (2) as a dispersing agent were added to 180 ml of an aqueous 5.6% gelatin solution and milled in a mill, using glass beads having a mean grain size of 0.75 mm, for 30 minutes. After the glass beads were separated, a dispersion of the pigment was obtained.

The other pigments of the present invention were formed into their dispersions in the same manner as above.

Light-sensitive material samples Nos. 102 to 104 were prepared in the same manner as in the preparation of No. ! 01, except that the pigment shown in Table 9 below was added to the 4th layer and/or the 2nd layer.

In addition, light-sensitive material samples Nos. 105to 112 were prepared also in the same manner, except that the alginic acid derivative indicated in Table 9 below was added to the pigment-containing layer(s) in Samples Nos. 102 to 104.

Apart from these, the coating compositions for the 2nd layer and the 4th layer were stored at 40° C for 24 hours and then coated in the same manner as above to prepare light-sensitive materials.

TABLE 9

| Light-sensitive material Sample No. | 4th Layer Pigment | Amount Coated | Alginic Acid Derivative | Amount Coated | 2nd Layer Pigment | Amount Coated | Alginic Acid Derivative | Amount Coated | Remarks |
|---|---|---|---|---|---|---|---|---|---|
| 101 | — | — | — | — | — | — | — | — | comparison |
| 102 | (27) | 120 | — | — | — | — | — | — | comparison |
| 103 | (27) | 80 | — | — | (23) | 30 | — | — | comparison |
| 104 | (3) | 120 | — | — | — | — | — | — | comparison |
| 105 | (27) | 120 | sodium alginate (polymerization degree: 600) | 36 | — | — | — | — | invention |
| 106 | (27) | 120 | sodium alginate (polymerization degree: 400) | 36 | — | — | — | — | invention |
| 107 | (27) | 120 | sodium alginate (polymerization degree: 250 or less) | 36 | — | — | — | — | invention |
| 108 | (27) | 120 | ammonium alginate | 60 | — | — | — | — | invention |
| 109 | (27) | 120 | propylene glycol alginate | 60 | — | — | — | — | invention |
| 110 | (27) | 120 | triethanol-amine alginate | 60 | — | — | — | — | invention |
| 111 | (27) | 80 | sodium alginate (polymerization degree: 250 or less) | 24 | (23) | 30 | sodium alginate (polymerization degree: 250 or less) | 9 | invention |
| 112 | (3) | 120 | sodium alginate (polymerization degree: 250 or less) | 48 | — | — | — | — | invention |

Note:
Amount Coated ($mg/m^2$)

Preparation of an image-receiving material sample

Image-receiving material sample $R_{101}$ having the constitution as shown in Table 10 below was prepared.

TABLE 10

Constitution of Image-Receiving Material Sample R101

| Layer No. | Components | Amount Coated ($mg/m^2$) |
|---|---|---|
| 4th Layer | Water-Soluble Polymer (3) | 240 |
| | Water-Soluble Polymer (4) | 60 |
| | Potassium Nitrate | 50 |
| | Surfactant (2) | 7 |
| | Surfactant (5) | 5 |
| 3rd Layer | Gelatin | 250 |
| | Water-Soluble Polymer (3) | 10 |
| | Surfactant (6) | 27 |
| | Hardening Agent (2) | 170 |
| 2nd Layer | Gelatin | 800 |
| | Water-Soluble Polymer (3) | 100 |
| | Water-Soluble Polymer (5) | 660 |
| | Polymer Dispersion | 1190 |
| | High-Boiling Point Solvent (5) | 650 |
| | Fluorescent Brightening Agent | 22 |
| | Mordant Agent | 2350 |
| | Surfactant (2) | 10 |
| | Guanidine Picolinate | 2900 |
| | Stain Inhibitor | 32 |
| 1st Layer | Gelatin | 150 |
| | Water-Soluble Polymer (3) | 40 |
| | Surfactant (2) | 6 |
| | Surfactant (6) | 27 |
| | Hardening Agent (2) | 170 |
| Support (2) | Polyethylene-Laminated Paper Support (thickness: 206 μm) | |

TABLE 10-continued

Constitution of Support (2)

| Name | Components | Layer Thickness (μm) |
|---|---|---|
| Surface Undercoat Layer | Gelatin | 0.1 |
| Surface PE Layer (glossy) | Low Density Polyethylene (density 0.923): 89.2 parts; Surface-Processed Titanium Oxide: 10.0 parts; Ultramarine: 0.8 part | 35.0 |
| Pulp Layer | High Quality Paper (LBKP/NBKP = 1/1, density 1.080) | 140.8 |
| Back PE Layer | High Density Polyethylene (density 0.960) | 30.0 |
| Back Undercoat Layer | Gelatin | 0.05 |
| | Colloidal Silica | 0.05 |
| | | 206.0 (total) |

Water-Soluble Polymer (3):

Sumikagel L5-H (produced by Sumitomo Chemical Company, Limited)
Water-Soluble Polymer (4):
κ-Carrageenan (Taito Co., Ltd.)
Water-Soluble Polymer (5):
Dextran (molecular weight: 70,000)
Polymer Dispersion:
Nipol LX814 (NIPPON ZEON CO., LTD.)
Surfactant (5):

$$C_8F_{17}SO_2\underset{\underset{C_3H_7}{|}}{N}CH_2COOK$$

TABLE 10-continued

Surfactant (6):

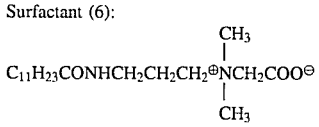

High-Boiling Point Solvent (5):
$C_{26}H_{46.9}Cl_{7.1}$ (AJINOMOTO CO., INC.)
Fluorecent Brightening Agent:

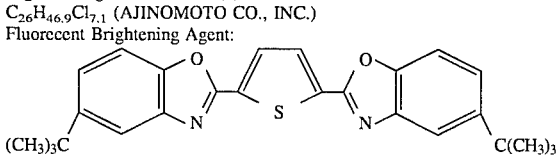

Stain Inhibitor:

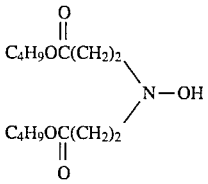

Mordant Agent:

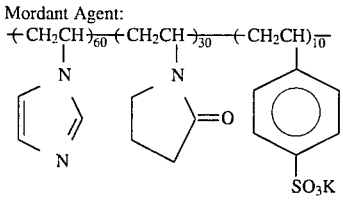

Hardening Agent (2):

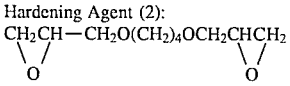

Each of the above-mentioned light-sensitive material samples Nos. 101. to 112 was combined with the above-mentioned image-receiving material sample R101 and processed with an image recording processor Pictrostat 200 produced by Fuji Photo Film Co., Ltd. Specifically, the light-sensitive material sample was exposed with an original (test chart with wedges of yellow (Y), magenta (M), cyan (Cy) and gray each having a continuously varying color density) through a slit by scanning exposure, the exposed sample was dipped in water kept at 40° C for 2.5 seconds, it was squeezed with rollers and then immediately attached to the image-receiving material sample in such a way that the coated top surfaces of the two faced each other, and the combined samples were heated with heat drum for 17 seconds in such a way that the surfaces of both elements which now had water applied thereto were heated up to 80° C. Then, the light-sensitive material sample was peeled off from the image-receiving material sample, whereupon a sharp color image well corresponding to the original was formed on the image-receiving material sample.

Using Fuji CC Filter produced by Fuji Photo Film Co., Ltd. by which the gray density was adjusted to be at 0.7, all the light-sensitive material samples were exposed and processed in the same! manner, and the Y, M and Cy densities of the images formed on the processed samples were measured at the point corresponding to the point in the original having an M density of 1.2. The densities measured were reflection densities. On the basis of the thus-measured densities, the color reproducibility of the samples was assessed. To measure the reflection densities, used was a densitometer X-Lite 404 produced by X Lite Co. To measure the number of the non-colored points, the samples were exposed and processed in the same manner as above to have a gray density of 0.7, while using a uniform gray original having a density of 1.0. In each of the thus-formed images, the number of the small uncolored points in the area of 1000 $cm^2$ was counted with the naked eye. To determine the easiness of washing the coating compositions used,, the coating compositions for the pigment-containing layers each were applied onto a stainless steel plate and dried, and the thus-coated plate was left in a running water at 40° C whereupon the degree of the components remained on the plate was measured with the naked eye. For Sample No. 101, the coating compositions for the 2nd and the 4th layers were tested.

To assess the raw stock storability, the samples were stored at 35° C and 80% RH for 15 days and then exposed and processed in the same manner as above.

The results obtained are shown in Table 11 below.

TABLE 11

| Light-Sensitive Material Sample | M density of 1.5 Dmin | | | Dmin After Dmax | | | Dmax After in the Original | | | tions Raw Stock | | | tions Raw Stock | | | Number of Uncolored Points (coating composi- in were not | Number of Uncolored Points (coating composi- were | Easiness Wash- |
|---|---|---|---|---|---|---|---|---|---|---|---|---|---|---|---|---|---|---|
| No. | Cy | M | Y | Cy | M | Y | Cy | M | Y | Cy | M | Y | Cy | M | Y | aged) | aged) | ing |
| 101 | 0.08 | 0.12 | 0.09 | 2.46 | 2.41 | 2.20 | 0.15 | 1.25 | 0.40 | 0.10 | 0.14 | 0.13 | 2.47 | 2.43 | 2.23 | 0 to 1 | 0 to 1 | good |
| 102 | 0.08 | 0.12 | 0.11 | 2.44 | 2.40 | 2.22 | 0.14 | 1.49 | 0.42 | 0.17 | 0.20 | 0.26 | 2.45 | 2.42 | 2.23 | 0 to 1 | 5 to 10 | bad |
| 103 | 0.09 | 0.13 | 0.10 | 2.48 | 2.44 | 2.23 | 0.12 | 1.44 | 0.41 | 0.19 | 0.22 | 0.25 | 2.48 | 2.45 | 2.24 | 0 to 1 | 5 to 10 | bad |
| 104 | 0.08 | 0.12 | 0.10 | 2.47 | 2.42 | 2.24 | 0.13 | 1.48 | 0.39 | 0.22 | 0.24 | 0.29 | 2.47 | 2.43 | 2.24 | 0 to 1 | 5 to 10 | bad |
| 105 | 0.08 | 0.11 | 0.09 | 2.46 | 2.41 | 2.24 | 0.14 | 1.50 | 0.41 | 0.11 | 0.14 | 0.14 | 2.47 | 2.42 | 2.24 | 0 to 1 | 0 to 1 | good |
| 106 | 0.09 | 0.12 | 0.11 | 2.45 | 2.40 | 2.22 | 0.15 | 1.51 | 0.40 | 0.12 | 0.15 | 0.13 | 2.45 | 2.44 | 2.23 | 0 to 1 | 0 to 1 | good |
| 107 | 0.08 | 0.11 | 0.10 | 2.46 | 2.44 | 2.21 | 0.13 | 1.49 | 0.40 | 0.11 | 0.14 | 0.15 | 2.47 | 2.42 | 2.22 | 0 to 1 | 0 to 1 | good |
| 108 | 0.09 | 0.12 | 0.09 | 2.47 | 2.41 | 2.22 | 0.12 | 1.48 | 0.39 | 0.12 | 0.14 | 0.15 | 2.48 | 2.42 | 2.23 | 0 to 1 | 1 to 2 | good |
| 109 | 0.08 | 0.13 | 0.11 | 2.46 | 2.42 | 2.21 | 0.14 | 1.50 | 0.41 | 0.12 | 0.14 | 0.15 | 2.47 | 2.43 | 2.22 | 0 to 1 | 1 to 2 | good |
| 110 | 0.09 | 0.12 | 0.09 | 2.48 | 2.41 | 2.23 | 0.14 | 1.51 | 0.40 | 0.13 | 0.14 | 0.13 | 2.47 | 2.42 | 2.24 | 0 to 1 | 1 to 2 | good |
| 111 | 0.08 | 0.13 | 0.10 | 2.46 | 2.44 | 2.23 | 0.15 | 1.48 | 0.42 | 0.11 | 0.15 | 0.14 | 2.47 | 2.45 | 2.24 | 0 to 1 | 0 to 1 | good |
| 112 | 0.09 | 0.12 | 0.09 | 2.45 | 2.41 | 2.21 | 0.13 | 1.50 | 0.40 | 0.12 | 0.14 | 0.13 | 2.45 | 2.42 | 2.22 | 0 to 1 | 0 to 1 | good |

From Table 11 above, it is known that, in Sample No. 101, the image formed had a low M density relative to the M density in the original. Thus, it is known therefrom that the coloring failure in the image formed in Sample No. 101 was large and the color reproducibility of Sample No. 101 was bad. It is also known therefrom that Samples Nos. 102 to 104 had good color reproducibility but had poor raw stock storability (especially with respect to Dmin). In particular, these had many small uncolored points, and the washability of the coating compositions for these was bad. On the other hand, Samples Nos. 105 to 112 of the present invention were good in that they had good color reproducibility and good raw stock storability. In addition, uncolored points were not almost formed in the images of the samples of the present invention and the coating compositions for the samples of the present invention were washed out easily.

The same results as above were obtained also when the pigment was added to the light-sensitive layers of the light-sensitive material samples.

While the invention has been described in detail and with reference to specific embodiments thereof, it will be apparent to one skilled in the art that various changes and modifications can be made therein without departing from the spirit and scope thereof.

What is claimed is:

1. A heat-developable color light-sensitive material comprising, on a support, at least a light-sensitive silver halide, a non-diffusible dye-donating compound capable of releasing or forming a diffusible dye in correspondence or reverse correspondence with a reaction of reducing the silver halide to silver, and a binder, which contains a solid organic pigment represented by the following formula (I) in at least one layer of a light-sensitive silver halide emulsion layer and its adjacent layers and which contains an alginic acid derivative in the same layer containing the solid organic pigment:

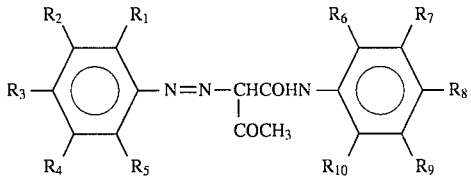

wherein $R_1$, $R_2$, $R_3$, $R_4$, $R_5$, $R_6$, $R_7$, $R_8$, $R_9$ and $R_{10}$ each represents a hydrogen atom or a substituent selected from the group consisting of a halogen atom, an alkyl group, an alkoxy group, a nitro group, an acyl group, an aryl group, an aryloxy group, a sulfamoyl group, an alkylsulfamoyl group, an arylsulfamoyl group, an alkoxycarbonyl group, an aryloxycarbonyl group, a carbamoyl group, an alkylcarbamoyl group, an arylcarbamoyl group, an acylamino group, an alkylsulfonylamino group, an arylsulfonylamino group, a ureido group, and a group represented by the following formula (II), which may be substituted by one or more of said substituents:

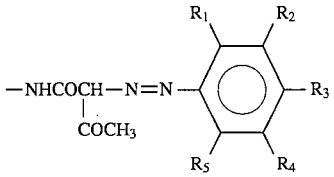

wherein $R_1$, $R_2$, $R_3$, $R_4$ and $R_5$ in formula (II) have the same meanings as $R_1$, $R_2$, $R_3$, $R_4$ and $R_5$ in formula (I), however each are the same as or different from those in formula (I); $R_1$ and $R_2$; $R_2$ and $R_3$; $R_3$ and $R_4$; $R_4$ and $R_5$; $R_6$ and $R_7$; $R_7$ and $R_8$; $R_8$ and $R_9$; or $R_9$ and $R_{10}$ may be combined with each other to form a heterocylic ring; and the pigment may be a biscompound formed by bonding two formulae (I) via $R_3$ or $R_8$, or via a single bond at a position of $R_3$ or $R_8$.

2. The heat-developable color light-sensitive material as claimed in claim 1, wherein the algininc acid derivative is contained in an amount of from 0.01 to 10 parts by weight based on one part by weight of the solid organic pigment represented by formula (I) in the same layer.

3. A method for producing a heat-developable color light-sensitive material comprising coating, on a support, at least a light-sensitive silver halide, a non-diffusible dye-donating compound capable of releasing or forming a diffusible dye in correspondence or reverse correspondence with a reaction of reducing the silver halide to silver, and a binder, which material contains a solid organic pigment represented by the following formula (I) in at least one layer of a light-sensitive silver halide emulsion layer and its adjacent layers and which contains an alginic acid derivative in the same layer containing the solid organic pigment, wherein the alginic acid derivative is contained in a coating solution of the solid organic pigment:

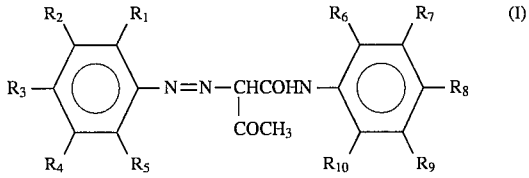

and wherein $R_1$, $R_2$, $R_3$, $R_4$, $R_5$, $R_6$, $R_7$, $R_8$, $R_9$ and $R_{10}$ each represents a hydrogen atom or a substituent selected from the group consisting of a halogen atom, an alkyl group, an alkoxy group, a nitro group, an acyl group, an aryl group, an aryloxy group, a sulfamoyl group, an alkylsulfamoyl group, an arylsulfamoyl group, an alkoxycarbonyl group, an aryloxycarbonyl group, a carbamoyl group, an alkylcarbamoyl group, an arylcarbamoyl group, an acylamino group, an alkylsulfonylamino group, an arylsutfonylamino group, a ureido group, and a group represented by the following formula (II), which may be substituted by one or more of said substituents:

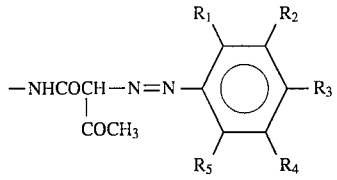

wherein $R_1$, $R_2$, $R_3$, $R_4$ and $R_5$ in formula (II) have the same meanings as $R_1$, $R_2$, $R_3$, $R_4$ and $R_5$ in formula (I), however each are the same as or different from those in formula (I); $R_1$ and $R_2$; $R_2$ and $R_3$; $R_3$ and $R_4$; $R_4$ and $R_5$; $R_6$ and $R_7$; $R_7$ and $R_8$; $R_8$ and $R_9$; or $R_9$ and $R_{10}$ may be combined with each other to form a heterocylic ring; and the pigment may be a biscompound formed by bonding two formulae (I) via $R_3$ or $R_8$, or via a single bond at a position of $R_3$ or $R_8$.

* * * * *